US005773186A

United States Patent [19]

Takashima

[11] Patent Number: 5,773,186

[45] Date of Patent: Jun. 30, 1998

[54] HEAT-SENSITIVE RECORDING MATERIAL

[75] Inventor: Masanobu Takashima, Fujinomiya, Japan

[73] Assignee: Fuji Photo Film Co., Ltd., Kanagawa, Japan

[21] Appl. No.: 801,948

[22] Filed: Feb. 18, 1997

[30] Foreign Application Priority Data

Feb. 19, 1996 [JP] Japan ..... 8-030899
Feb. 19, 1996 [JP] Japan ..... 8-030970

[51] Int. Cl.[6] ..... G03C 1/54

[52] U.S. Cl. ..... 430/138; 430/157; 430/162; 430/171; 430/178

[58] Field of Search ..... 430/138, 157, 430/162, 171, 178

[56] References Cited

U.S. PATENT DOCUMENTS

| | | | |
|---|---|---|---|
| 2,976,145 | 3/1961 | Baril, Jr. et al. | 430/171 |
| 3,486,900 | 12/1969 | Tsunoda et al. | 430/171 |
| 3,620,740 | 11/1971 | Poot | 430/171 |
| 3,944,422 | 3/1976 | Nihyakumen et al. | 430/171 |
| 4,400,458 | 8/1983 | Walkow et al. | 430/157 |
| 4,450,648 | 5/1984 | Scheler | 430/171 |
| 4,957,847 | 9/1990 | Adam et al. | 430/170 |
| 5,424,268 | 6/1995 | Fehervari et al. | 503/227 |

*Primary Examiner*—John S. Chu
*Attorney, Agent, or Firm*—Sughrue, Mion, Zinn, Macpeak & Seas, PLLC

[57] ABSTRACT

A heat-sensitive recording material comprises a substrate and a heat-sensitive recording layer provided on the substrate, and the heat-sensitive layer contains a diazo compound and a coupler compound which produces color, reacting with the diazo compound. The heat-sensitive recording material contains a diazo compound represented by the following general formula (I) or (II)

General Formula I

General Formula II wherein $R^1$ to $R^4$ each independently represents a hydrogen atom, an alkyl group, —$OR^5$, —$SR^6$, —$NR^7R^8$, —$COR^{10}$, a halogen atom, —$SO_2R^{10}$, —CN, —$NO_2$, or the like, in which $R^7$ and $R^8$ are coupled together to form an alkylene group which may contain —O—, —S—, —$SO_2$— or —$NR^9$; A represents —CO— or —$S0_2$—; B represents —$SO_2R^{11}$ or —$POR^{12}R^{13}$, in which $R^{11}$ represents an alkyl group, —$NR^7R^8$ or the like and $R^{12}$ and $R^{13}$ each independently represents an alkyl group, an aryl group or the like, $R^{21}$ to $R^{24}$ each independently represents a hydrogen atom, an alkyl group, an aryl group, —$OR^{25}$, —$SR^{26}$, —$NR^{27}R^{28}$, —$COR^{30}$, or the like, and at least one of $R^{21}$ to $R^{24}$ represents any one of an aryloxy group, an arylthio group and —$NR^{27}R^{28}$, in which $R^{27}$ and $R^{28}$ are coupled together to form an alkylene group which may contain —O—, —S—, —$SO_2$— or —$NR^{29}$; C represents —CO— or —$SO_2$—; D represents a hydrogen atom, a hydroxyl group, —$COR^{31}$, —$CR^{32}NR^{33}R^{34}$ or the in which $R^{31}$ represents an alkyl group or the like, $R^{32}$ represents =O or =S, and $R^{33}$ and $R^{34}$ each independently represents a hydrogen atom, an alkyl group or the like.

20 Claims, No Drawings

HEAT-SENSITIVE RECORDING MATERIAL

BACKGROUND OF THE INVENTION

1. Field of the Invention

This invention relates to a heat-sensitive recording material. More specifically, this invention relates to a heat-sensitive recording material which is excellent in light fastness and has a light fixing property.

2. Description of the Related Art

Recently, heat-sensitive recording has been finding increasing use since a recording apparatus employed for it is simple and convenient, is highly reliable and does not need maintenance. As the heat-sensitive recording material, widely known are those making use of the reaction between an electron donating colorless dye and an electron accepting compound, those making use of the reaction between a diazonium salt compound and a coupler, and the like.

In recent years, studies on the improvement of the properties of the heat-sensitive recording material, for example, (1) a chromophoric density and chromophoric sensitivity, and (2) color fastness of a chromophoric product, have been extensively conducted.

The heat-sensitive recording material is, however, accompanied with the drawbacks that when exposed to sunlight for long hours or is posted for a long period of time in an office or the like, the coloration of a non-image portion of the heat-sensitive material due to light, or discoloration or fading of an image portion occurs.

Various methods have been proposed to overcome the coloration of the non-image portion or discoloration or fading of the image portion, however, they have not yet brought about sufficient effects.

The conventional heat-sensitive recording materials are accompanied with another drawback that when these materials are employed, the non-image portion or image portion changes in color by the exposure to a chemical or heat, and there is a fear of these portions being altered so that the conventional materials are unsuitable for important documents as the quality thereof cannot be maintained over a long period of time. Accordingly, there is the need for the development of a heat-sensitive recording material capable of imparting a light fixing property and preventing quality change and alteration after the formation of the image, while making the best use of the properties of the material.

SUMMARY OF THE INVENTION

An object of the present invention is to provide a heat-sensitive recording material being excellent in light fastness and having a light fixing property.

The above-described object could be attained by a heat-sensitive recording material comprising a substrate and a heat-sensitive recording layer provided on the substrate, said heat sensitive recording layer containing a diazo compound and a coupler compound which produces color by the reaction with the diazo compound. The heat-sensitive recording material contains, as the diazo compound, a compound represented by the following general formula (I) or (II):

General Formula I

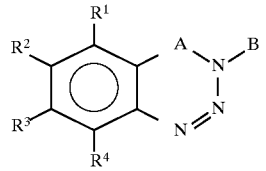

wherein $R^1$ to $R^4$ each independently represents a hydrogen atom, an alkyl group, an aryl group, —$OR^5$, —$SR^6$, —$NR^7R^8$, —$COR^{10}$, a halogen atom, —$SO_2R^{10}$, —CN and —$NO_2$, in which $R^5$ and $R^6$ each independently represents a hydrogen atom, an alkyl group, an aryl group or an acyl group, $R^7$ and $R^8$ each independently represents a hydrogen atom, an alkyl group, an aryl group, an acyl group, an alkylsulfonyl group or an arylsulfonyl group and $R^7$ and $R^8$ are coupled together to form an alkylene group which may contain —O—, —S—, —$SO_2$— or —$NR^9$, $R^9$ representing a hydrogen atom, an alkyl group, an aryl group, an acyl group, an alkylsulfonyl group, an arylsulfonyl group, an alkoxycarbonyl group or an aryloxycarbonyl group, and $R^{10}$ represents a hydrogen atom, a hydroxyl group, an alkyl group, an aryl group, an alkoxyl group, an aryloxy group or —$NR^7R^8$, $R^7$ and $R^8$ having the same meanings-as defined above;

A represents —CO— or —$SO_2$—; and

B represents —$SO_2R^{11}$ or —$POR^{12}$ $R^{13}$, in which $R^{11}$ represents an alkyl group, an aryl group, a heterocyclic group or —$NR^7R^8$, $R^7$ and $R^8$ having the same meanings as defined above, and $R^{12}$ and $R^{13}$ each independently represents an alkyl group, an aryl group, an alkoxyl group or an aryloxy group.

General Formula II

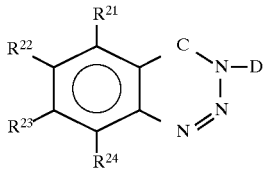

wherein $R^{21}$ to $R^{24}$ each independently represents a hydrogen atom, an alkyl group, an aryl group, —$OR^{25}$, —$SR^{26}$, —$NR^{27}R^{28}$, —$COR^{30}$, a halogen atom, —$SO_2R^{30}$, —CN, —$NO_2$ and at least one of $R^{21}$ to $R^{24}$ represents any one of an aryloxy group, an arylthio group, —$NR^{27}R^{28}$, in which $R^{25}$ and $R^{26}$ each independently represents a hydrogen atom, an alkyl group, an aryl group or an acyl group, $R^{27}$ and $R^{28}$ each independently represents a hydrogen atom, an alkyl group, an aryl group, an acyl group, an alkylsulfonyl group or an arylsulfonyl group and $R^{27}$ and $R^{28}$ are coupled together to form an alkylene group which may contain —O—, —S—, —$SO_2$— or —$NR^{29}$, $R^{29}$ representing a hydrogen atom, an alkyl group, an aryl group, an acyl group, an alkylsulfonyl group, an arylsulfonyl group, an alkoxycarbonyl group or an aryloxycarbonyl group, and $R^{30}$ represents a hydrogen atom, a hydroxyl group, an alkyl group, an aryl group, an alkoxyl group, an aryloxy group or —$NR^{27}R^{28}$, $R^{27}$ and $R^{28}$ having the same meanings as defined above;

C represents —CO— or —$SO_2$—; and

D represents a hydrogen atom, a hydroxyl group, an alkyl group, an aryl group, a heterocyclic group, —$COR^{31}$ or —$CR^{32}NR^{33}R^{34}$, in which $R^{31}$ represents an alkyl group, an aryl group, an alkoxyl group, an aryloxy group or a heterocyclic group, $R^{32}$ represents =O or =S, and $R^{33}$ and $R^{34}$ each independently represents a hydrogen atom, an alkyl group, an aryl group, an alkylsulfonyl group or an arylsulfonyl group.

The properties of the heat-sensitive recording material according to the present invention are eminent when the compound represented by the formula (I) or (II) has been micro-encapsulated.

According to the present invention, the heat-sensitive recording material has an excellent light fastness and a light fixing property so that it exhibits excellent advantages.

DETAILED DESCRIPTION OF THE PREFERRED EMBODIMENTS

The present invention will hereinafter be described in further detail.

A description will next be made of the compound represented by the formula (I) or (II) which is a chromophoric component in the heat-sensitive recording material according to the present invention. Among the substituents in the formula (I) or (II), the alkyl group may be linear or branched, or may contain an unsaturated bond. The alkyl group may be substituted by an alkoxyl group, an aryloxy group, an alkoxycarbonyl group, an aryloxycarbonyl group, an aryl group, a hydroxyl group or a halogen atom. Furthermore, the aryl group may be substituted by an alkyl group, an alkoxyl group, a nitro group, a cyano group, a hydroxyl group or a halogen atom.

The compound represented by the formula (I) or (II) is, as can be seen from its structure, a compound having a benzotriazine skeleton. The compound is, however, a cyclic derivative obtained by diazotization reaction and has a light fixing property similar to a diazonium salt compound so that it will be hereinafter called diazo compound for convenience' sake. It has not been known at all that the compound represented by the formula (I) or (II) has a light fixing property when used for a heat-sensitive recording material.

Preferred examples of the substituent represented by any one of $R^1$ to $R^4$ in the formula (I) and $R^{21}$ to $R^{24}$ in the formula (II) include a hydrogen atom; an alkyl group having 1–18 carbon atoms; an aryl group having 6–18 carbon atoms; a halogen atom such as fluorine, chlorine or bromine; —$OR^5$ or $OR^{25}$ where $R^5$ or $R^{25}$ represents an alkyl group having 1–22 carbon atoms, an aryl group having 6–22 carbon atoms or an acyl group having 2–22 carbon atoms; —$SR^6$ or —$SR^{26}$ where $R^6$or $R^{26}$ represents an alkyl group having 1–22 carbon atoms, an aryl group having 6–22 carbon atoms or an acyl group having 2–22 carbon atoms; —$NR^7R^8$ or —$NR^{27}R^{28}$ in which $R^7$ or $R^{27}$ represents a hydrogen atom, an alkyl group having 1–22 carbon atoms or an aryl group having 6–22 carbon atoms and $R^8$ or $R^{28}$ represents an alkyl group having 1–22 carbon atoms, an aryl group having 6–22 carbon atoms or an acyl group having 2–22 carbon atoms, and $R^7$ and $R^8$ or $R^{27}$ and $R^{28}$ are coupled to form an alkylene group which has 4–10 carbon atoms and may contain —O—, —S—, —$SO_2$— or —$NR^9$— or —$NR^{29}$— ($R^9$ or $R^{29}$ preferably representing a hydrogen atom, an alkyl group having 1–18 carbon atoms, an aryl group having 6–18 carbon atoms or an acyl group having 2–18 carbon atoms) ; and —$COR^{10}$, —$SO_2R^{10}$, —$COR^{30}$, —$SO_2R^{30}$, —CN or —$NO_2$ in which $R^{10}$ or $R^{30}$ represents an alkyl group having 1–18 carbon atoms, an aryl group having 6–18 carbon atoms, an alkoxy group having 1–18 carbon atoms or an aryloxy group having 6–18 carbon atoms. Particularly preferred are a hydrogen atom; an alkyl group having 1–12 carbon atoms; an aryl group having 6–12 carbon atoms; a fluorine or chlorine atom; —$OR^5$ or $OR^{25}$ where $R^5$ or $R^{25}$ represents an alkyl group having 1–16 carbon atoms or an aryl group having 6–16 carbon atoms; —$SR^6$ or $SR^{26}$ where $R^6$ or $R^{26}$ represents an alkyl group having 1–16 carbon atoms or an aryl group having 6–16 carbon atoms; —$NU^7R^8$ or —$NR^{27}R^{28}$ in which $R^7$ or $R^{27}$ represents a hydrogen atom, an alkyl group having 1–16 carbon atoms or an aryl group having 6–16 carbon atoms and $R^8$ or $R^{28}$ represents an alkyl group having 1–16 carbon atoms, an aryl group having 6–16 carbon atoms or an acyl group having 2–16 carbon atoms, or $R^7$ and $R^8$ or $R^{27}$ and $R^{28}$ are coupled to form an alkylene group which has 4–6 carbon atoms and may contain —O—, —S—, —$SO_2$— or —$NR^9$— or —$NR^{29}$—; and —$COR^{10}$, —$SO_2R^{10}$, —$COR^{30}$, —$SO_2R^{30}$, —CN or —$NO_2$ in which $R^{10}$ or $R^{30}$ represents an alkyl group having 1–12 carbon atoms, an aryl group having 6–12 carbon atoms, an alkoxy group having 1–12 carbon atoms or an aryloxy group having 6–12 carbon atoms.

For the improvement of the efficiency of the light fixing property, it is preferred that at least one of $R^1$ to $R^4$ is —$OR^5$, —$SR^6$, or —$NR^7R^8$.

Preferred examples of the substituent represented by B include —$SO_2R^{11}$ in which $R^{11}$ represents an alkyl group having 1–22 carbon atoms, —$NR^7R^8$ having 2–22 carbon atoms, an aryl group having 6–22 carbon atoms or a heterocyclic group containing N, O or S; and —$POR^{12}R^{13}$ in which $R^{12}$ and $R^{13}$ each independently represents an alkyl group or an alkoxyl group having 1–18 carbon atoms, an aryl group or an aryloxy group having 6–18 carbon atoms. Particularly preferred are —$SO_2R^{11}$ in which $R^{11}$ represents an alkyl group having 1–16 carbon atoms, an aryl group having 6–16 carbon atoms, and —$POR^{12}R^{13}$ in which $R^{12}$ and $R^{13}$ each independently represents an alkoxy group having 1–12 carbon atoms or an aryloxy group having 6–12 carbon atoms. From the viewpoint of the reactivity with the coupler compound, —$SO_2R^{11}$ is more preferred.

Preferred examples of the substituent represented by D include —$COR^{31}$ in which $R^{31}$ represents an alkyl group having 1–22 carbon atoms, an aryl group having 6–22 carbon atoms, an alkoxyl group having 1–22 carbon atoms, an aryloxy group having 6–22 carbon atoms or a heterocyclic group containing N, O or S; —$CR^{32}NR^{33}R^{34}$ in which $R^{33}$ and $R^{34}$ each independently represents a hydrogen atom, an alkyl group having 1–22 carbon atoms, an aryl group having 6–22 carbon atoms, an alkylsulfonyl group having 1–22 carbon atoms or an arylsulfonyl group having 6–22 carbon atoms; an alkyl group having 1–22 carbon atoms; an aryl group having 6–22 carbon atoms; and a heterocyclic group containing N, O or S. Among them, particularly preferred are —$COR^{31}$ in which $R^{31}$ represents an alkyl group having 1–16 carbon atoms, an aryl group having 6–16 carbon atoms, a heterocyclic group containing N, O or S, an alkoxy group having 1–16 carbon atoms or an aryloxy group having 6–16 carbon atoms; —$CR^{32}NR^{33}R^{34}$ in which $R^{33}$ and $R^{34}$ each independently represents a hydrogen atom, an alkyl group having 1–16 carbon atoms, an aryl group having 6–16 carbon atoms; an aryl group having 6–12 carbon atoms; and a heterocyclic group containing N, O or S. From the viewpoint of the reactivity with a coupler compound, an aryl group, a heterocyclic group, —$COR^{31}$ and —$CR^{32}NR^{33}R^{34}$ are more preferred.

The specific examples of each of the above-described substituents will hereinafter be exemplified. It should, however, be borne in mind that the present invention will not be limited to or by these examples.

Specific examples of $R^1$ to $R^4$include a hydrogen atom, a phenyl group, a tolyl group, a methyl group, an ethyl group, an n-propyl group, an isopropyl group, an n-butyl group, an isobutyl group, a sec-butyl group, a t-butyl group, a pentyl group, a hexyl group, an octyl group, a decyl group, a dodecyl group, an allyl group, a 2-butenyl group, a benzyl group, an α-dimethylbenzyl group, a methoxy group, an ethoxy group, a propyloxy group, a butyloxy group, an octyloxy group, a dodecyloxy group, an octadecyloxy group, a 2-ethylhexyloxy group, a methoxyethoxy group, a phenoxyethoxy group, a 4-methoxyphenoxyethoxy group, a phenoxy group, a chlorophenoxy group, a 4-octyloxyphenoxy group, an acetyloxy group, a butyryloxy group, a benzoyloxy group, a methylthio group, an ethylthio group, a butylthio group, a hexylthio group, an octylthio group, a dodecylthio group, an octadecylthio group, a benzylthio group, a phenethylthio group, aphenylthio group, a tolylthio group, a chlorophenylthio group, a methoxyphenylthio group, a dimethylamino group, a diethylamino group, a dipropylamino group, a dibutylamino group, a dioctylamino group, an N-methyl-N-cyclohexylamino group, a diphenylamino group, an N-ethyl-N-tolylamino group, an acetylamino group, a propionylamino group, an isobutyrylamino group, a pivaloylamino group, a myristoylamino group, a stearoylamino group, an acryloylamino group, a benzoylamino group, a cinnamoylamino group, a morpholino group, a piperidino group; a pyrrolidino group, an N-butyrylpiperazino group, an ethoxycarbonyl group, a phenyloxycarbonyl group, a carbamoyl group, a fluorine atom, a chlorine atom, a bromine atom, a sulfamoyl group, a methanesulfonylamino group, a benzenesulfonylamino group, an octylaminosulfonyl group, a phenylaminosulfonyl group, a trifluoromethyl group, an octylaminocarbonylmethyloxy group, a di(butyloxycarbonylmethyl)amino group, a di(dibutylaminocarbonylmethyl)amino group, a dicyanoethylamino group, a dicyanoethylamino group, a methylsulfonyl group, an ethylsulfonyl group, a butylsulfonyl group, an octylsulfonyl group, a phenylsulfonyl group, a tolylsulfonyl group, a chlorophenylsulfonyl group, a butyloxyphenylsulfonyl group, a sulfo group, a methoxysulfonyl group, a phenoxysulfonyl group, a cyano group and a nitro group.

Specific examples of $R^{21}$ to $R^{24}$ include a hydrogen atom, a phenyl group, a tolyl group, a methyl group, an ethyl group, an n-propyl group, an isopropyl group, an n-butyl group, an isobutyl group, a sec-butyl group, a t-butyl group, a pentyl group, a hexyl group, an octyl group, a decyl group, a dodecyl group, an allyl group, a 2-butenyl group, a benzyl group, an a-dimethylbenzyl group, a methoxy group, an ethoxy group, a propyloxy group, a butyloxy group, an octyloxy group, a dodecyloxy group, an octadecyloxy group, a 2-ethylhexyloxy group, a methoxyethoxy group, a phenoxyethoxy group, a 4-methoxyphenoxyethoxy group, a phenoxy group, a chlorophenoxy group, a 4-octyloxyphenoxy group, an acetyloxy group, a butyryloxy group, a benzoyloxy group, a methylthio group, an ethylthio group, a butylthio group, a hexylthio group, an octylthio group, a dodecylthio group, an octadecylthio group, a benzylthio group, a phenethylthio group, a phenylthio group, a tolylthio group, a chlorophenylthio group, a methoxyphenylthio group, a dimethylamino group, a diethylamino group, a dipropylamino group, a dibutylamino group, a dioctylamino group, an N-methyl-N-cyclohexylamino group, a diphenylamino group, an N-ethyl-N-tolylamino group, an acetylamino group, a propionylamino group, an isobutyrylamino group, a pivaroylamino group, a myristoylamino group, a stearoylamino group, an acryloylamino group, a benzoylamino group, a cinnamoylamino group, a morpholino group, a piperidino group, a pyrrolidino group, an N-butyrylpiperazino group, an ethoxycarbonyl group, a phenyloxycarbonyl group, a carbamoyl group, a fluorine atom, a chlorine atom, a bromine atom, a butanesulfonylamino group, a benzenesulfonylamino group, a trifluoromethyl group, an octylaminocarbonylmethyloxy group, a di(butyloxycarbonylmethyl)amino group, a di(dibutylaminocarbonylmethyl)amino group, a dicyanoethylamino group, a dicyanoethylamino group, a methylsulfonyl group, a butylsulfonyl group, a phenylsulfonyl group, a methoxysulfonyl group, a sulfo group, a cyano group, or a nitro group.

Specific examples of the substituent represented by B include a methanesulfonyl group, an ethanesulfonyl group, a butanesulfonyl group, a benzenesulfonyl group, a 4-methylbenzenesulfonyl group, a 2-mesytylenesulfonyl group, a 4-methoxybenzenesulfonyl group, a 4-octyloxybenzenesulfonyl group, a 2,4,6-triisopropylbenzenesulfonyl group, a β-styrenesulfonyl group, a vinylbenzenesulfonyl group, a 4-chlorobenzenesulfonyl group, a 2,5-dichlorobenzenesulfonyl group, a 2,4,5-trichlorobenzenesulfonyl group, a 1-naphthalensulfonyl group, a 2-naphthalensulfonyl group, a quinolinesulfonyl group, a thiophenesulfonyl group, a nitrobenzenesulfonyl group, a cyanobenzenesulfonyl group, a acetylaminobenzenesulfonyl group, a butoxycarbonylbenzenesulfonyl group, a pentafluorobenzenesulfonyl group, a trifluoromethanesulfonyl group, a perfluorobutanesulfonyl group, a camphorsulfonyl group, a dimethylaminosulfonyl group, a diphenylphosphoryl group and a diethylphosphoryl group.

The specific examples of the substituent represented by D include an acetyl group, a propionyl group, a butyryl group, apivaloylgroup, alauroylgroup, astearoylgroup, a benzoyl group, a cinnamoyl group, a furoyl group, a nicotinoyl group, a methoxycarbonyl group, an ethoxycarbonyl group, a phenoxycarbonyl group, a hexylaminocarbonyl group, a phenylaminocarbonyl group, a phenylsulfonylaminocarbonyl group, a hydrogen atom, a methyl group, an ethyl group, a butyl group, a cyclohexyl group, a benzyl group, a cyanomethyl group, a dimethylaminocarbonyl group, a morpholinocarbonyl group, a trifluoroacetyl group, a methyl benzoyl group, a methoxybenzoyl group, a trifluoromethylbenzoyl group, a nitrobenzoyl group, a difluorobenzoyl group, a pentafluorobenzoyl group, a hydroxymethyl group, a phenyl group, a tolyl group, a methoxyphenyl group, a chlorophenyl group, a cyanophenyl group, a nitrophenyl group, a naphthyl group, a pyridyl group and a furfuryl group.

The specific examples of the compound represented by the formula (1) will hereinafter be shown, but the present invention will not be limited to or by these examples. These compounds can be used either singly or in combination.

General Formula I

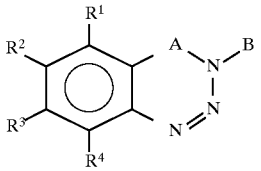

| Specific Example | $R^1$ | $R^2$ | $R^3$ | $R^4$ | A | B |
|---|---|---|---|---|---|---|
| 1 | H | H | H | H | CO | 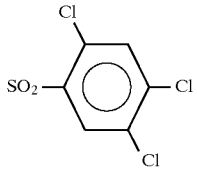 |
| 2 | H | 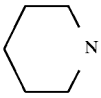 | H | H | CO | 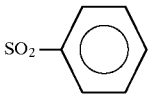 |
| 3 | H | 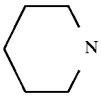 | H | H | CO | 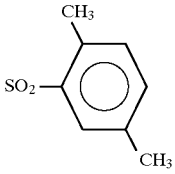 |
| 4 | H | 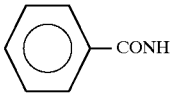 | n-$C_8H_{17}O$ | H | $SO_2$ | 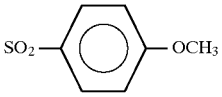 |
| 5 | H | $(n\text{-}C_8H_{17})_2N$ | $CH_3$ | H | CO | 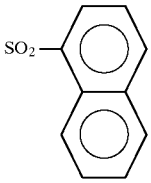 |
| 6 | H | 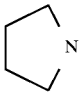 | n-$C_8H_{17}O$ | H | CO | 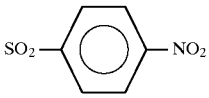 |
| 7 | H | 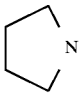 | n-$C_8H_{17}O$ | H | CO | 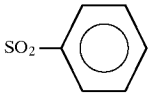 |
| 8 | H | 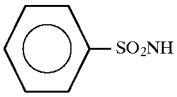 | H | H | CO | 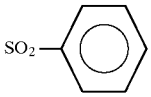 |
| 9 | H | 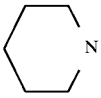 | $C_4H_9O$ | H | CO | 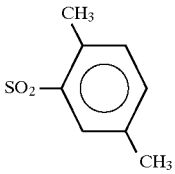 |
| 10 | H | 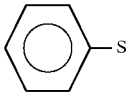 | H | H | CO | 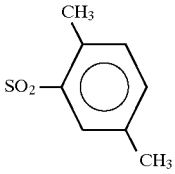 |
| 11 | H | 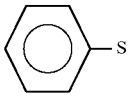 | H | H | CO | $SO_2CH_3$ |

-continued
| Specific Example | $R^1$ | $R^2$ | $R^3$ | $R^4$ | A | B |
|---|---|---|---|---|---|---|
| 12 | H | 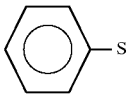 | H | H | CO | 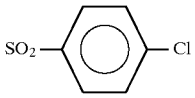 |
| 13 | H | 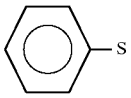 | $C_4H_9O$ | H | CO | 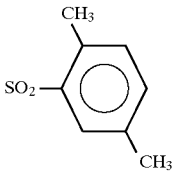 |
| 14 | H | 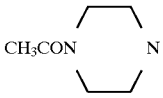 | H | H | CO | 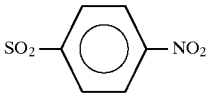 |
| 15 | H | 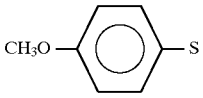 | $n\text{-}C_4H_9CH(C_2H_5)CH_2O$ | H | CO | 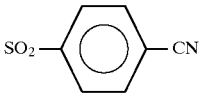 |
| 16 | H | 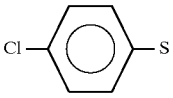 | $CH_3O$ | $CH_2{=}CHCH_2$ | CO | 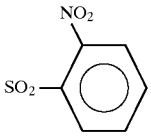 |
| 17 | H | $C_4H_9O$ | $C_4H_9O$ | H | CO | 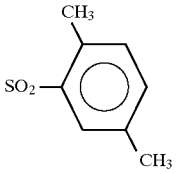 |
| 18 | H | $n\text{-}C_6H_{13}O$ | $n\text{-}C_6H_{13}O$ | $n\text{-}C_6H_{13}O$ | CO | 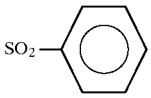 |
| 19 | $C_4H_9O$ | H | $C_4H_9O$ | H | CO | 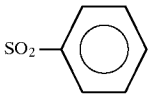 |
| 20 | H | $CH_3SO_2$ | H | H | CO | 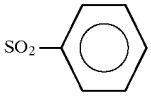 |
| 21 | H | H | CN | H | CO | 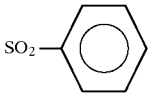 |
| 22 | H | H | $CO_2C_2H_5$ | H | CO | 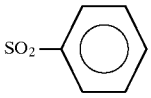 |
| 23 | H | Cl | $n\text{-}C_8H_{17}O$ | H | CO | 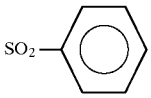 |
| 24 | H | 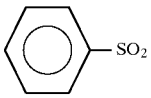 | H | H | CO | 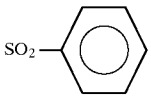 |

-continued

| Specific Example | $R^1$ | $R^2$ | $R^3$ | $R^4$ | A | B |
|---|---|---|---|---|---|---|
| 25 | H | 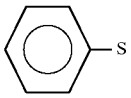 | H | H | CO | $PO\left(OCH_2\underset{C_2H_5}{\overset{C_4H_9}{CH}}\right)_2$ |

The specific examples of the compound represented by the formula (II) will hereinafter be shown but the present invention will not be limited to or by these examples. The compounds represented by the formula (II) can be used either singly or in combination. It is also possible to use the compound represented by the formula (I) and the compound represented by the formula (II) in combination. In this case, two or more compounds may be used as each of the compounds represented by the formulae (I) and (II).

| Specific Example | $R^{21}$ | $R^{22}$ | $R^{23}$ | $R^{24}$ | C | D |
|---|---|---|---|---|---|---|
| 26 | H | 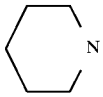 | H | H | $SO_2$ | 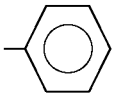 |
| 27 | H | $(C_6H_{13})_2N$ | H | H | $SO_2$ | 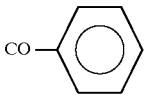 |
| 28 | H | 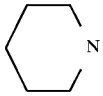 | H | H | CO | 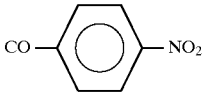 |
| 29 | H | 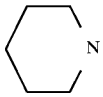 | H | H | CO | 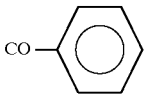 |
| 30 | H | 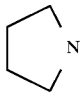 | H | H | CO | $C_4H_9$ |
| 31 | H | 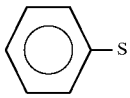 | H | H | $SO_2$ | 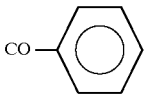 |
| 32 | H | 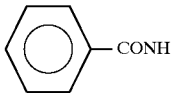 | H | H | CO | 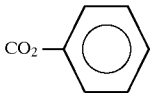 |
| 33 | H | H | $C_{17}H_{35}CONH$ | H | $SO_2$ | 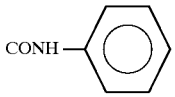 |
| 34 | H | 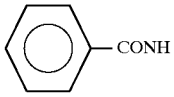 | n-$C_8H_{17}O$ | H | $SO_2$ | 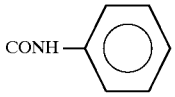 |
| 35 | H | 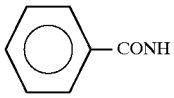 | $C_4H_9\underset{C_2H_5}{\overset{}{C}}HCH_2O$ | H | $SO_2$ | 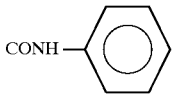 |

-continued
| Specific Example | $R^{21}$ | $R^{22}$ | $R^{23}$ | $R^{24}$ | C | D |
|---|---|---|---|---|---|---|
| 36 | H | $CH_3CONH$ | 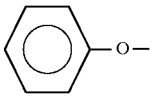 | H | $SO_2$ | $CO_2C_2H_5$ |
| 37 | H | $CH_3SO_2NH$ | $C_4H_9O$ | H | $SO_2$ | 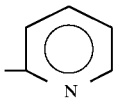 |
| 38 | H | 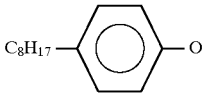 | H | H | $SO_2$ | 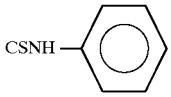 |
| 39 | H | 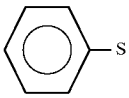 | H | H | CO | 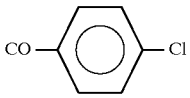 |
| 40 | H | 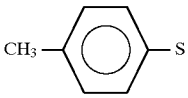 | H | H | CO | $CONHC_4H_9$ |
| 41 | H | 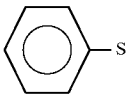 | H | H | CO | 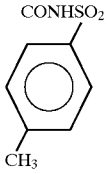 |
| 42 | H | 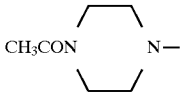 | H | H | $SO_2$ | 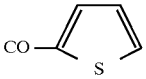 |
| 43 | H | $CH_3CONH$ | H | H | $SO_2$ | 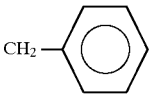 |
| 44 | H | 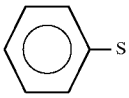 | H | H | CO | 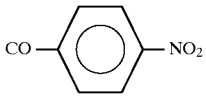 |
| 45 | 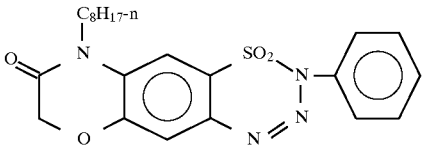 | | | | | |
| 46 | 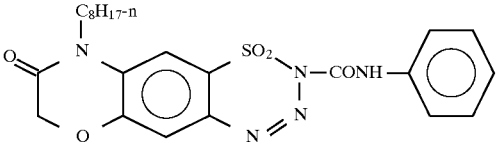 | | | | | |
| 47 | 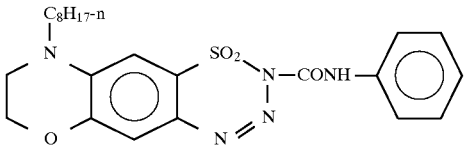 | | | | | |

A diazo compound represented by the general formula (I) can be prepared by diazotization of an amino compound represented by the formula 1, followed by intramolecular cyclization; or by allowing a diazo compound represented by the formula 2 to react with X-B (in which X represents a halogen atom) optionally in the presence of a base such as pyridine, triethylamine, potassium carbonate or sodium hydroxide).

Formula 1

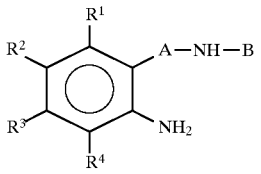

Formula 2

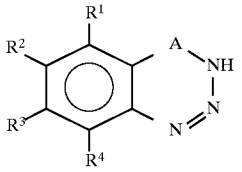

A diazo compound represented by the general formula (II) can be prepared by the diazotization of an amino compound represented by the formula 3, followed by intramolecular cyclization; or by allowing a diazo compound represented by the formula 4to react with X-D (in which X represent a halogen atom), or, an isocyanate compound corresponding to D group, optionally in the presence of a base such as pyridine, triethylamine, potassium carbonate or sodium hydroxide).

Formula 3

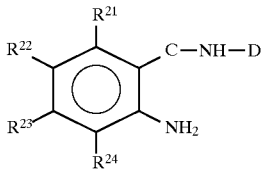

Formula 4

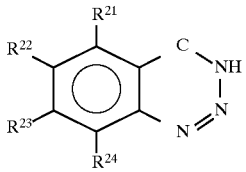

In the heat-sensitive recording material which contains the compound represented by the formula (I) or (II), it is preferred to use the compound after subjecting the compound to (1) solid dispersion, (2) emulsion dispersion, (3) polymer dispersion, (4) latex dispersion or (5) micro-encapsulation. Among them, use after micro-encapsulation is particularly preferred.

It is preferred that the amount of the compound represented by the formula (I) or (II) is 0.02–3.0 g/m$^2$, more preferably 0.1–2.0 g/m$^2$ in the heat-sensitive material. If the amount is smaller than 0.02 g/m$^2$, the chromophoric density becomes insufficient. If the amount is larger than 3.0 g/m$^2$, stain of the heat-sensitive material after light fixation increases and problems may arise.

A detailed description will next be made of the method to incorporate the compound represented by the formula (I) or (II) in the heat sensitive material.

In the case where the compound represented by the formula (I) or (II) is subjected to emulsion dispersion, the compound is first dissolved in oil. The oil may be either solid or liquid at normal temperature. The oil may be in the form of polymer. Examples include low-boiling point solvents, such as acetate esters, methylene chloride and cyclohexanone which can be used together with high boiling point solvents and/or phosphate esters, phthalate esters, acrylate esters, methacrylate esters, other carboxylate esters, fatty acid amides, alkylated biphenyls, alkylated terphenyls, alkylated naphthalenes, diaryl ethanes, chlorinated paraffins, alcohol type oils, phenol type oils, ether type oils, monoolefin type oils and epoxy type oils. Specific examples include high boiling point oils such as tricresyl phosphate, trioctyl phosphate, octyldiphenyl phosphate, tricyclohexyl phosphate, dibutyl phthalate, dioctyl phthalate, dilauryl phthalate, dicyclohexyl phthalate, butyl olefinate, diethylene glycol benzoate, dioctyl sebacate, dibutyl sebacate, dioctyl adipate, trioctyl trimellitate, acetyltriethyl citrate, octyl maleate, dibutyl maleate, isoamyl biphenyl, chlorinated paraffin, diisopropylnaphthalene, 1,1'-ditolylethane, 2,4-di-t-amylphenol, N,N-dibutyl-2-butoxy-5-t-octylaniline, 2-ethylhexyl hydroxybenzoate, polyethylene glycol and α-methylstyrene dimers. Among them, alcohol type, phosphate-ester type and carboxylate-ester type oils and alkylated biphenyls, alkylated terphenyls, alkylated naphthalenes and diarylethanes are particularly preferred. It is also possible to add an antioxidant such as hindered phenol and hindered amine to the above-exemplified high boiling point oil.

The oil solution containing the compound represented by the formula (I) or (II) is added to an aqueous solution of a water-soluble macromolecule, followed by emulsion dispersion by use of a colloid mill, homogenizer or ultrasonic wave. Polyvinyl alcohol or the like is used as a water-soluble macromolecule for emulsion dispersion. It is also possible to use an emulsion or latex of a hydrophobic macromolecule in combination with the water-soluble macromolecule. Illustrative of the water-soluble macromolecule include polyvinyl alcohol, silanol-modified polyvinyl alcohol, carboxy-modified polyvinyl alcohol, amino-modified polyvinyl alcohol, itaconic-acid-modified polyvinyl alcohol, styrene-maleic anhydride copolymer, butadiene-maleic anhydride copolymer, ethylene-maleic anhydride copolymer, isobutylene-maleic anhydride copolymer, polyacrylamide, polystyrenesulfonic acid, polyvinyl pyrrolidone, ethylene-acrylic acid copolymer and gelatin. Among them, carboxy-modified polyvinyl alcohol is particularly preferred. Examples of the emulsion or latex of a hydrophobic macromolecule include styrene-butadiene copolymer, carboxy-modified styrene-butadiene copolymer and acrylonitrile-butadiene copolymer. During emulsion dispersion, known surfactants can be added as needed in order to-improve emulsion stability.

As the micro-encapsulation method of the compound represented by the formula (I) or (II), a micro-encapsulation method known to date can be employed. Described specifically, the micro-encapsulation is conducted by dissolving the compound of the formula (I) or (II) and a precursor for microcapsule wall in an organic solvent which is slightly soluble or insoluble in water, adding the resulting solution to an aqueous solution of a water-soluble macromolecule, and conducting emulsion dispersion using a homogenizer or the like. The resulting emulsion is heated to form a wall film made of a macromolecular substance, which is to be a microcapsule wall, on the oil-water interface. Specific examples of the macromolecular substance which forms the wall film of the microcapsule include polyurethane resin, polyurea resin, polyamide resin, polyester resin, polycarbonate resin, aminoaldehyde resin, melamine resin, polystyrene resin, styrene-acrylate copolymer resin, styrene-methacrylate copolymer resin, gelatin and polyvinyl alcohol and mixtures thereof. Among them, a microcapsule having a wall film formed of polyurethane and polyurea resins is particularly preferred.

The microcapsule having a wall film formed of polyurethane and polyurea resins is produced by mixing a precursor for a microcapsule wall such as polyisocyanates with a core substance to be encapsulated, subjecting the resulting mixture to emulsion dispersion in an aqueous solution of a water-soluble macromolecule such as polyvinyl alcohol and increasing the temperature of the emulsion to cause macromolecule formation reaction on the oil phase and water phase interface.

Here, some specific examples of the polyisocyanate compounds as a precursor for a microcapsule wall will next be described. Examples include diisocyanates such as m-phenylene diisocyanate, p-phenylene diisocyanate, 2,6-tolylene diisocyanate, 2,4-trilene diisocyanate, naphthalene-1,4-diisocyanate, diphenylmethane-4,4'-diisocyanate, 3,3'-diphenylmethane-4,4'-diisocyanate, xylene-1,4-diisocyanate, 4,4'-diphenylpropane diisocyanate, trimethylene diisocyanate, hexamethylene diisocyanate, propyolene-1,2-diisocyanate, butylene-1,2-diisocyanate, cyclohexylene-1,2-diisocyanate and cyclohexylene-1,4-diisocyanate; triisocyanates such as 4,4',4"-triphenylmethane triisocyanate and toluene-2,4,6-triisocyanate; tetraisocyanates such as 4,4'-dimethyldiphenylmethane-2,2',5,5'-tetraisocyanate; isocyanate prepolymers such as adduct of hexamethylene diisocyanate and trimethylol propane, adduct of 2,4-tolylene diisocyanate and trimethylol propane, adduct of xylylene diisocyanate and trimethylol propane and adduct of tolylene diisocyanate and hexane triol. It is also possible to use two or more of the above-exemplified isocyanate compounds in combination as needed. Among them, particularly preferred are those having at least three isocyanate groups in their molecules.

In the micro-encapsulation method, the oil exemplified above in the method of emulsion dispersion can be used as an organic solvent in which the compound represented by the formula (I) or (II) can be dissolved. Similar can be applied to the water-soluble macromolecule.

The microcapsule is preferred to have a particle size of 0.1–1.0 $\mu$m, with 0.22–0.7 $\mu$m being more preferred.

The heat-sensitive recording layer usable in the present invention, said layer containing the diazo compound represented by the formula (I) or (II) and a coupler compound which produces color by the reaction with the diazo compound, may further contain a basic substance for the acceleration of chromophoric reaction, a sensitizer for increasing thermal sensitivity, an antioxidant for the improvement of color fastness, a UV absorber and/or a metal salt or metal complex which can be chelated with the resulting colorant, or precursors thereof. These substances may be contained in the intermediate layer or protective layer.

Examples of the coupler which is usable in the present invention and produces color by the thermal reaction with the diazonium compound represented by the formula (I) or (II) include naphthol derivatives, hydroxynaphtoeic acid derivatives, phenol derivatives, pyrazolone derivatives, 1,3-diketone derivatives, ketocarboxamide derivatives, pyrazolotriazole derivatives, hydrazone derivatives, hydroxycumarine derivatives and barbituric acid derivatives which are known to date. For example, those described in U.S. Pat. No. 1,969,479, U.S. Pat. No. 3,265,506, 4,486,527, U.S. Pat. No. 4,659,644, British Patent No. 2,196,141, JP-A 61-273986, JP-A 64-67379 and JP-A 59-160136. Specific examples include resorcin, phloroglucinol, sodium 2,3-dihydroxynaphthalene-6-sulfonate, 1-hydroxy-2-naphthoic acid morpholinopropylamide, 1,5-dihydroxynaphthalene, 2,3-dihydroxynaphthalene, 2,3-dihydroxy-6-sulfanylnaphthalene, 2-hydroxy-3-naphthoic acid anilide, 2-hydroxy-3-naphthoic acid ethanolamide, 2-hydroxy-3-naphtoeic acid octylamide, 2-hydroxy-3-naphthoic acid-N-dodecyloxypropylamide, 2-hydroxy-3-naphthoic acid tetradecylamide, acetanilide, acetoacetoanilide, benzoylacetanilide, 2-chloro-5-octylaceto acetanilide, 1-phenyl-3-methyl-5-pyrazolone, 1-(2'-octylphenyl)-3-methyl-5-pyrazolone, 1-(2',4',6'-trichlorophenyl)-3-benzamide-5-pyrazolone, 1-(2',4',6'-trichlorophenyl)-3-anilino-5-pyrazolone, 1-phenyl-3-phenylacetamide-5-pyrazolone and Compounds (C-1) to (C-6) described below. These couplers can be used in combination to produce desired color hue.

Further, so-called four equivalent couplers which have been known in the area of silver halide photographic photosensitive materials can be used for the couplers in the present invention. These couplers can be selected for obtaining a desired color hue.

C-1

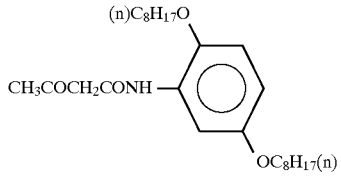

C-2

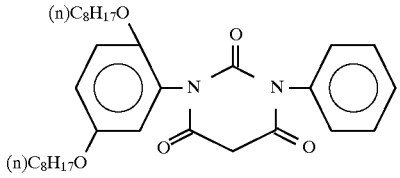

C-3

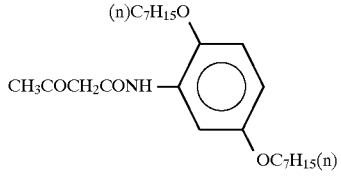

C-4

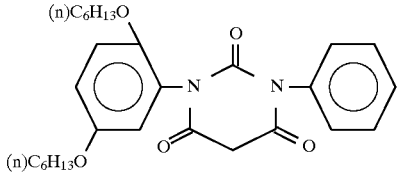

C-5

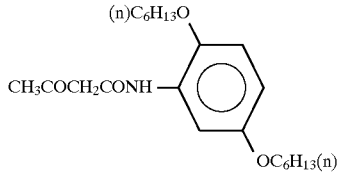

C-6

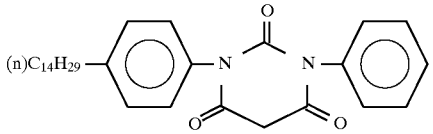

The basic substance usable in the present invention include, in addition to inorganic and organic basic compounds, compounds which release an alkali substance by the decomposition by heating. Representative examples include nitrogen-containing compounds such as organic ammonium salts, organic amines, amides, urea and thiourea and derivatives thereof; thiazoles, pyrroles, pyrimidines, piperazines, guanidines, indoles, imidazoles, imidazolines, triazoles, morpholines, piperidines, amidines, formamidines and pyridines. Specific examples include tricyclohexylamine, tribenzylamine, octadecylbenzylamine, stearylamine, allyl urea, thiourea, methyl thiourea, allyl thiourea, ethylene thiourea, 2-benzylimidazole, 4-phenylimidazole, 2-phenyl-4-methylimidazole, 2-undecylimidazoline, 2,4,5-trifuryl-2-imidazoline, 1,2-diphenyl-4,4-dimethyl-2-imidazoline, 2-phenyl-2-imidazoline, 1,2,3-triphenylguanidine, 1,2-dicyclohexylguanidine, 1,2,3-tricyclohexylguanidine, guanidine trichloroacetate, N,N'-dibenzylpiperazine, 4,4'-dithiomorpholine, morpholinium trichloroacetate, 2-aminobenzothiazole and 2-benzoylhydrazinobenzothiazole. Two or more compounds of the above-described compounds may be used in combination.

Sensitizers usable in the present invention include phenols, ethers, esters, sulfonamides, amides, ureas, urethanes and alcohols. Specific examples include 1,1-(4-hydroxyphenyl)-2-2-ethylhexane, benzyloxynaphthalene, toluenesulfonamide, butoxybenzenesulfonamide, 1,2-phenoxyethane, diphenylurea, benzamide and stearic acid amide. These sensitizers can be used in combination.

In the present invention, the using form of the diazo compound represented by the formula (I) or (II), the coupler which produces color by the reaction with the diazo compound when thermal recording is performed and the basic substance, and the sensitizer optionally used is not particularly limited. Similar to the compound of the formula (I) or (II), they can be used after being subjected to (1) solid dispersion, (2) emulsion dispersion, (3) polymer dispersion, (4) latex dispersion and (5) micro-encapsulation. Among them, the use after the micro-encapsulation is particularly preferred from the viewpoint of the stability on storage. Particularly, the micro-encapsulation of the diazo compound represented by the formula (I) or (II) is preferred.

In the present invention, below-exemplified antioxidants known to date can be used to impart the material with more improved light fastness. Examples of the antioxidant include those described in European Patent Application Laid-Open No. 310,551, German Offenlegungs Schrift DE-3,435,443, European Patent Application Laid-Open No. 310,552, JP-A 3-121449, European Patent Application Laid-Open No. 459,416, JP-A 2-262654, JP-A 2-71262, JP-A 63-163351, U.S. Pat. No. 4,814,262, JP-A 54-48535, JP-A 5-61166, JP-A 5-119449, U.S. Pat. No. 4,980,275, JP-A 63-113536, JP-A 62-262047, European Patent Application Laid-Open No.223,739, European Patent Application Laid-Open No. 309,402 and European Patent Application Laid-Open No. 309,401.

In addition, various additives known to date for heat-sensitive recording materials or pressure-sensitive recording materials can effectively be used as antioxidants. Some examples of antioxidants as additives include the compounds described in JP-A 60-125470, JP-A 60-125471, JP-A 60-125472, JP-A 60-287485, JP-A 60-287486, JP-A 60-287487, JP-A 62-146680, JP-A 60-287488, JP-A 62-282885, JP-A 63-89877, JP-A 63-88380, JP-A 63-088381, JP-A 1-239282, JP-A 04-291685, JP-A 04-291684, JP-A 05-188687, JP-A 05-188686, JP-A 05-110490, JP-A 05-1108437, JP-A 05-170361, JP-A 63-203372, JP-A 63-224989, JP-A 63-267594, JP-A 63-182484, JP-A 60-107384, JP-A 60-107383, JP-A 61-160287, JP-A 61-185483, JP-A 61-211079, JP-A 63-251282, JP-A 63-051174, JP-B 48-043294 and JP-B 48-033212.

Specific examples include 6-ethoxy-1-phenyl-2,2,4-trimethyl-1,2-dihydroquinoline, 6-ethoxy-1-octyl-2,2,4-trimethyl-1,2-dihydroquinoline, 6-ethoxy-1-phenyl-2,2,4-trimethyl-1,2,3,4-tetrahydroquinoline, 6-ethoxy-1-octyl-2,2,4-trimethyl-1,2,3,4-tetrahydroquinoline, cyclohexanoic acid nickel, 2,2-bis-4-hydroxyphenylpropane, 1,1-bis-4-hydroxyphenyl-2-ethylhexane, 2-methyl-4-methoxydiphenylamine and 1-methyl-2-phenylindole and the compounds described below.

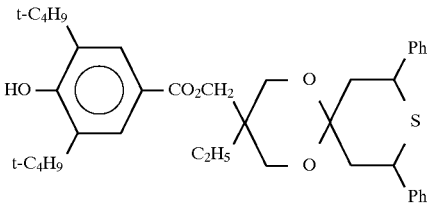

Q-1

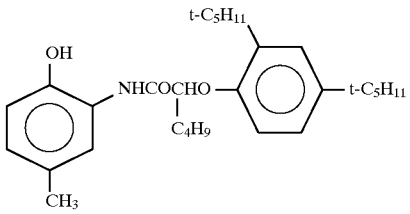

Q-2

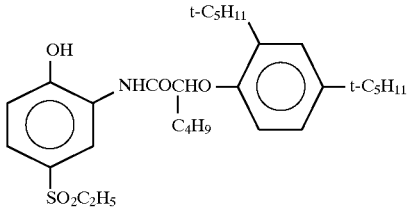

Q-3

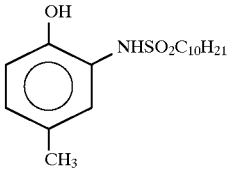

Q-4

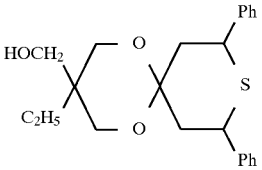

Q-5

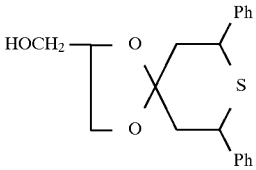

Q-6

-continued
Q-7
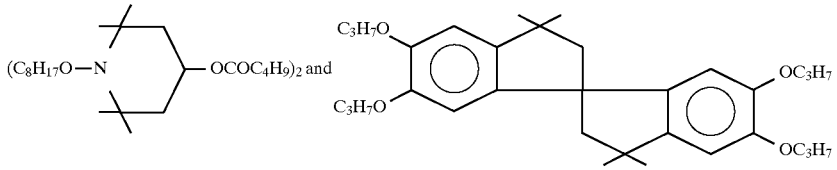
Q-8
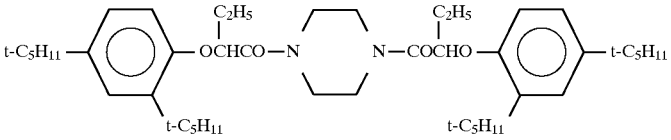
Q-9
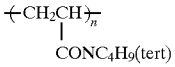
Q-10
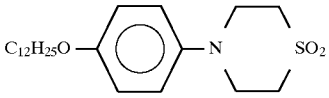
Q-11
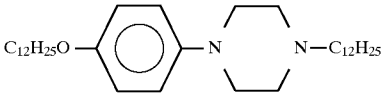
Q-12
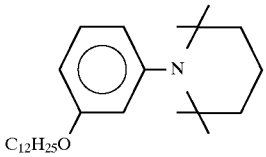
Q-13
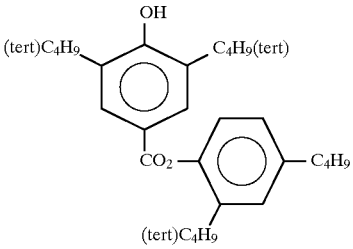
Q-14
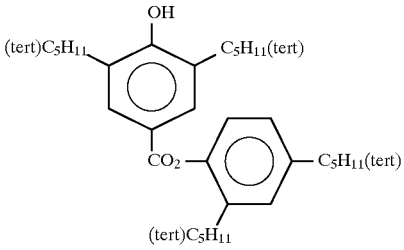
Q-15
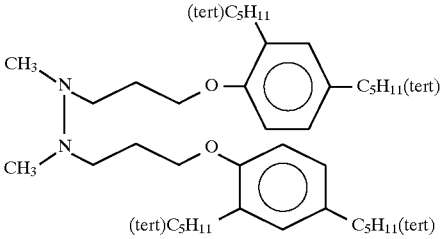
Q-16
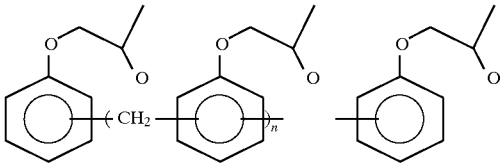
Q-17
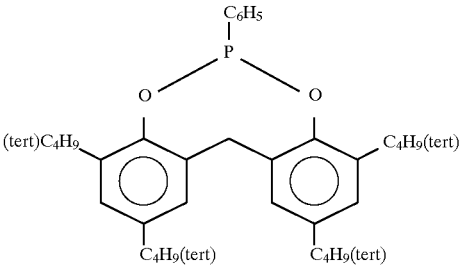
Q-18
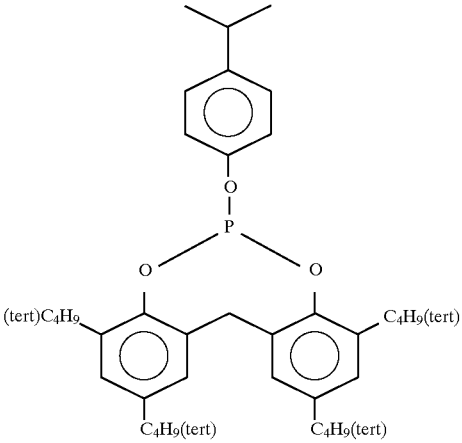

-continued
Q-19
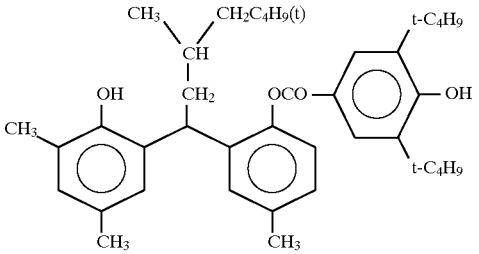
Q-20
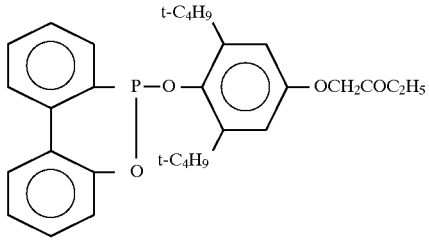
Q-21
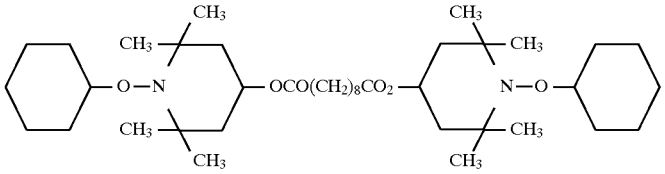
Q-22
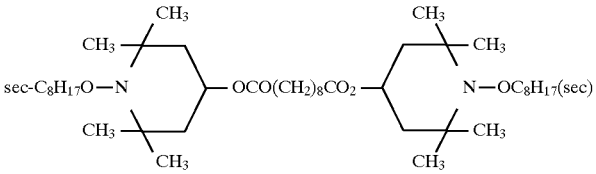
Q-23
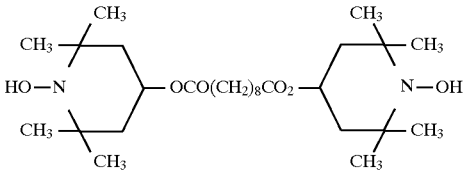
Q-24
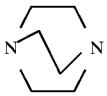
Q-25
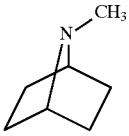
Q-26
$(C_{14}H_{29}OCOCH_2CH_2)_2S$
Q-27
$(C_{18}H_{37}OCOCH_2CH_2)_2S$
Q-28
$(C_{12}H_{25}SCH_2CH_2CO_2CH_2)_4C$
Q-29
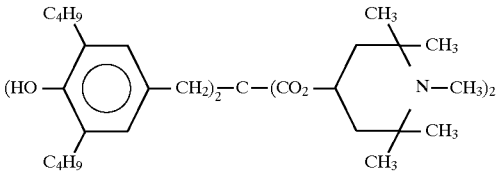
Q-30
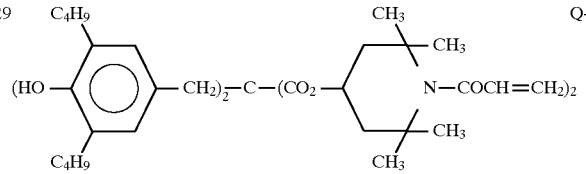
Q-31
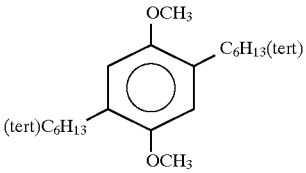
Q-32
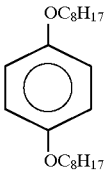
Q-33
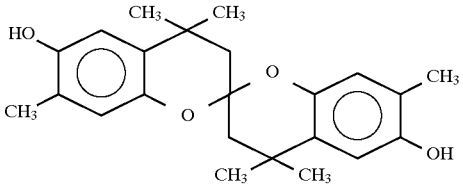

-continued
Q-34
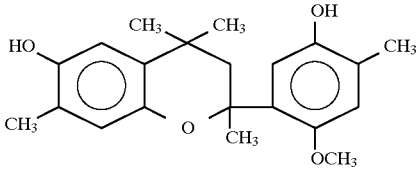
Q-35
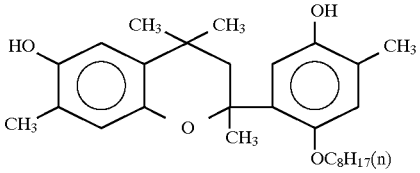
Q-36
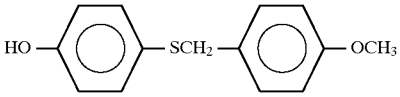
Q-37
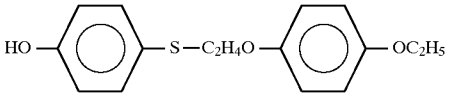
Q-38
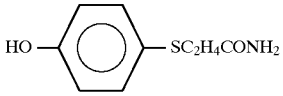
Q-39
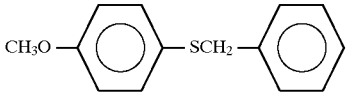
Q-40
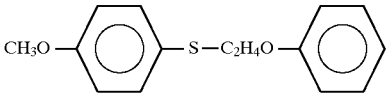
Q-41
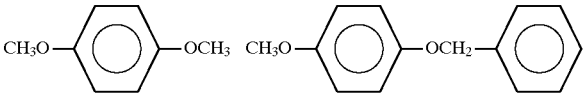
Q-42
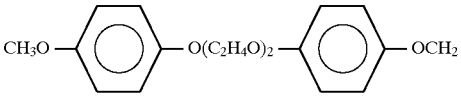
Q-43
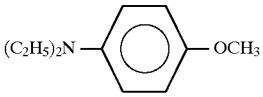
Q-44
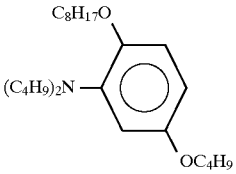
(B)
Q-45
(A)
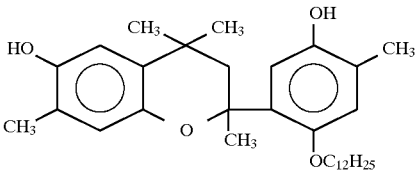
and
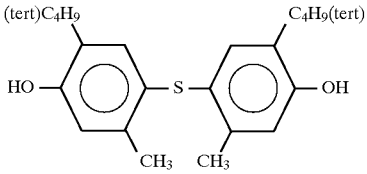
use of (A) and (B) in combination
Q-46
(A)
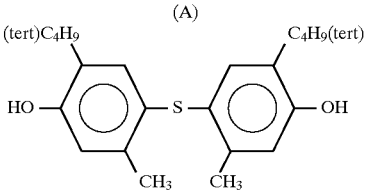
use of (A) and hydroquinone ether in combination
Q-47
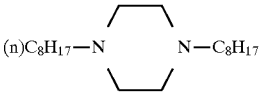
Q-48
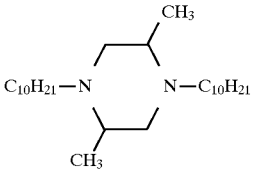
Q-49
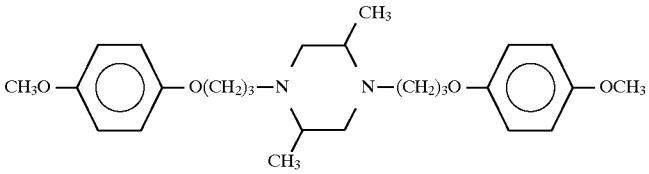

-continued
Q-50
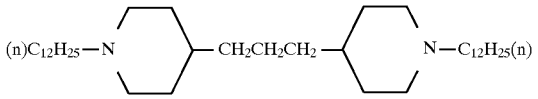
Q-51
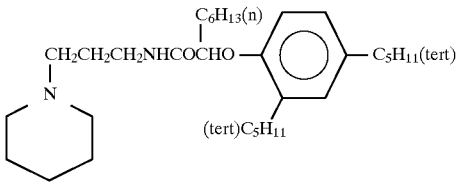
Q-52
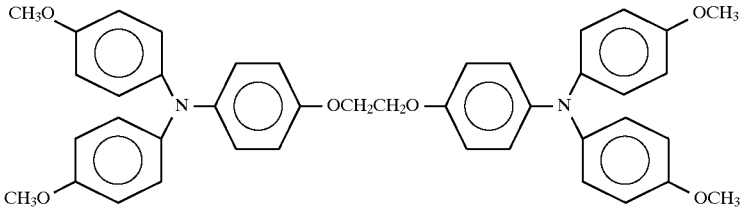
Q-53
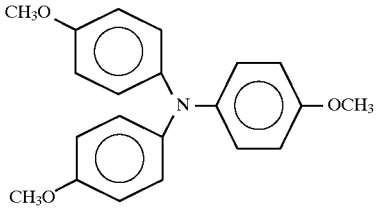
Q-54
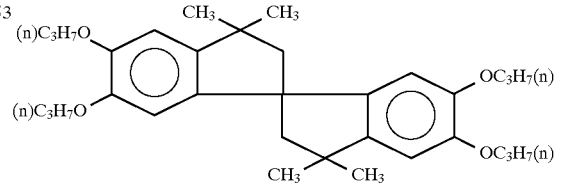
Q-55
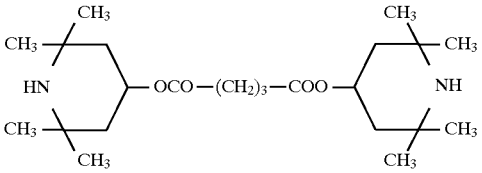
Q-56
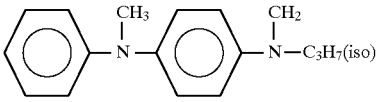
Q-57
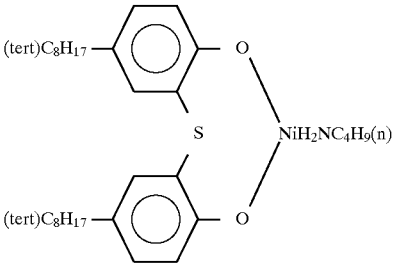
Q-58
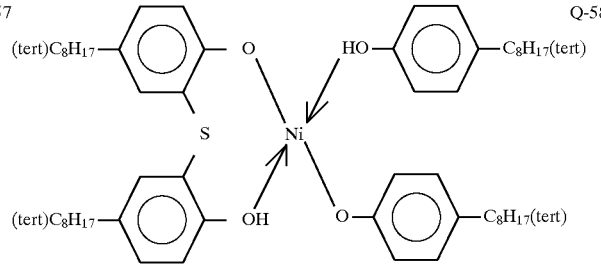
Q-59
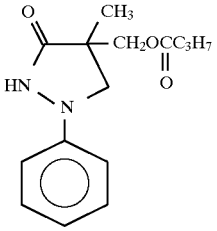
Q-60
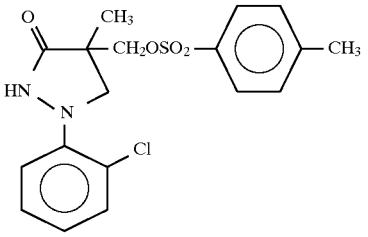
Q-61
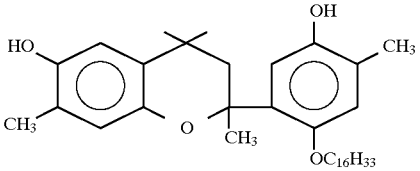
Q-62
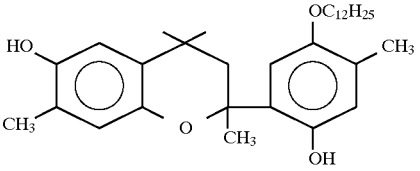

-continued

Q-63

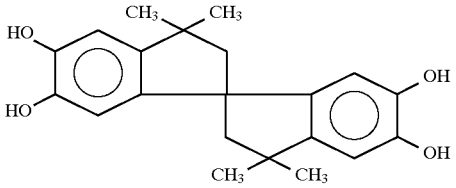

Q-64

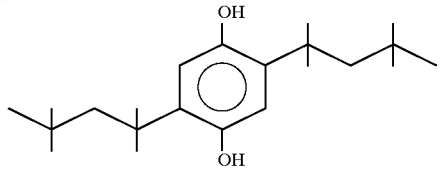

(Q-65)

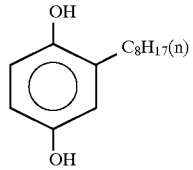

(Q-66)

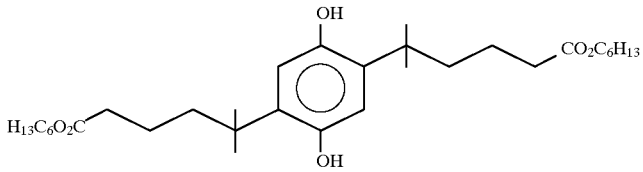

(Q-67)

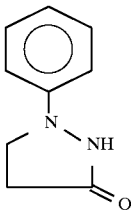

(Q-68)

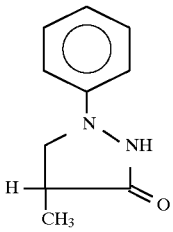

(Q-69)

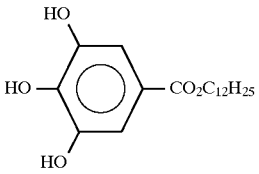

(Q-70)

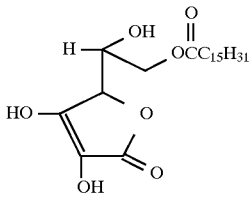

$CH_3(OCH_2CH_2)_3OCH_3$ (Q-71)

(Q-72)

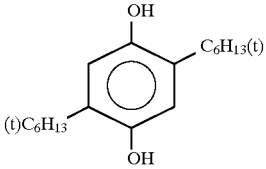

(Q-73)

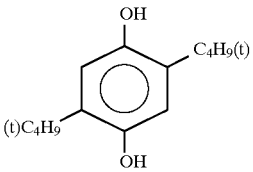

The above-exemplified antioxidants can be added to any one of the heat-sensitive recording layer, intermediate layer or protective layer. When they are used in combination, specific examples of the combination include the combination of Compound (Q-54) and Compound (Q-64).

Examples of the UV absorber or its precursor include hydroxybenzophenones, cinnamate esters, salicylate esters, benzotriazoles and triazines which are known to date. The specific examples of the UV absorber will be described below but the present invention will not be limited to or by these examples.

E-1

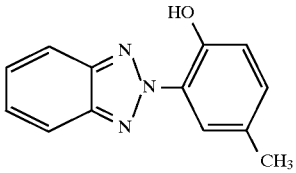

-continued

E-2

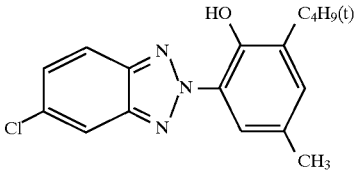

E-3

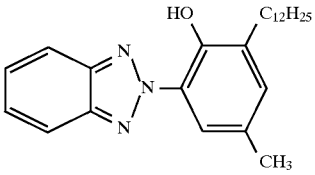

E-4

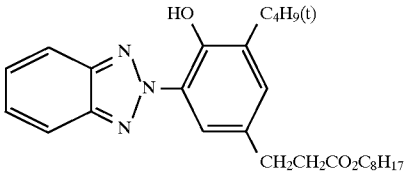

E-5

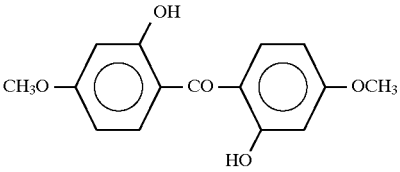

E-6

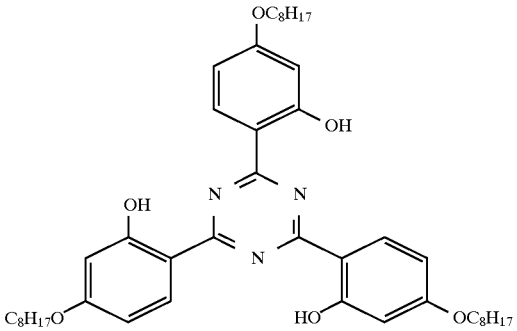

E-7

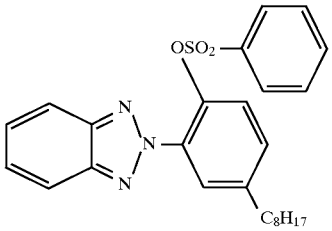

E-8

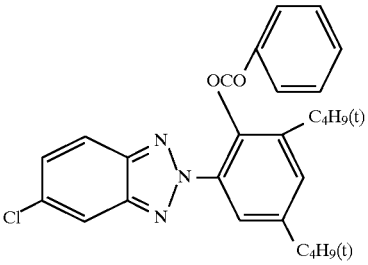

-continued

E-9

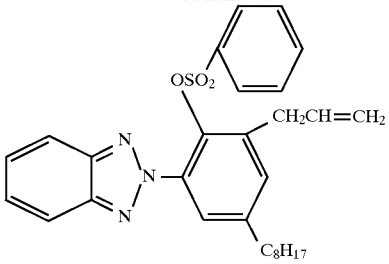

Each of these UV absorbers or precursors therefor can be added to any one of the protective layer, heat-sensitive chromophoric layer or intermediate layer after being subjected to emulsion dispersion, polymer dispersion, latex dispersion, solid dispersion or micro-encapsulation.

As the binder usable in the present invention, those known to date can be used. Specific examples include water-soluble macromolecules such as polyvinyl alcohol and gelatin and polymer latex.

Illustrative of the substrate usable in the present invention include plastic films, paper, plastic resins, laminated paper and synthetic paper.

In the case where heat-sensitive chromophoric layers different in color hue are superposed, an intermediate layer is interposed to prevent color mixing. As the intermediate layer, a water-soluble macromolecular compound is employed. Examples include polyvinyl alcohol, modified polyvinyl alcohol, methyl cellulose, sodium polystyrene sulfonate, styrene-maleic acid copolymers and gelatin.

To the protective layer of the present invention, various pigments, releasing agents and the like as well as water-soluble macromolecular compounds which are similar to those exemplified above as the intermediate layer can be added.

There is no particular limitation imposed on the constitution of the heat-sensitive recording material according to the present invention. A multi-color heat-sensitive recording material can be obtained by using at least two compounds represented by the formula (I) or (II) which are different in the maximum absorption wavelength. It is also possible to use, in combination with the compound represented by the formula (I) or (II), other chromophoric systems such as a chromophoric system using an electron-donating colorless dye and an electron accepting compound, a chromophoric system using a diazonium salt compound and a coupler compound which produces color by the reaction with the diazonium salt compound by heating, a basic chromophoric system which produces color in contact with a basic compound, a chelete chromophoric system, a chromophoric system which produces color, reacting with a nucleophilic agent and causing an elimination reaction. These compounds may exist in the same layer or may be in different layers.

Examples of the multi-color heat-sensitive recording material include (i) a heat-sensitive recording material in which a heat-sensitive recording layer containing a diazo compound which is represented by the formula (I) or (II) and has the maximum absorption wavelength of 360±20 nm, and a coupler which reacts with the diazo compound to produce color, and a heat sensitive recording layer containing a compound which is represented by the formula (I) or (II) and has the maximum absorption wavelength of 400±20 nm, and a coupler which reacts with the compound to produce color, the layers being coated on a support in this order; (ii) a heat-sensitive recording material in which a heat-sensitive recording layer containing a compound which is represented by the formula (I) or (II) and has the maximum absorption wavelength of 400±20 nm, and a coupler which reacts with the compound to produce color and a heat-sensitive recording layer containing a compound which is represented by the formula (I) or (II) and has the maximum absorption wavelength of 360±20 nm, and a coupler which reacts with the compound to produce color, the layers being coated on a support in this order; (iii) a heat-sensitive recording material in which a heat-sensitive recording layer which contains a compound represented by the formula (I) or (II) and has the maximum absorption wavelength of less than 340 nm, and a coupler which reacts with the compound to produce color, and a heat-sensitive recording layer containing a compound which is represented by the formula (I) or (II) and has the maximum absorption wavelength exceeding 420 nm, and a coupler which reacts with the compound to produce color, the layers being coated on a support in this order; (iv) a heat-sensitive recording material in which, a heat-sensitive recording layer containing a diazo compound which is represented by the formula (I) or (II) and has the maximum absorption wavelength of 400±20 nm, and a coupler which reacts with the compound to produce color, and a heat-sensitive recording layer containing a diazonium salt compound which has the maximum absorption wavelength of 360±20 nm, and a coupler which reacts with the diazonium salt compound to produce color, the layers being coated on a support in this order; and (v) heat-sensitive recording material in which a heat-sensitive recording layer containing a diazonium salt compound which has the maximum absorption wavelength of 400±20 nm, and a coupler which reacts with the diazonium salt compound to produce color, and a heat sensitive recording layer containing a compound which is represented by the formula (I) or (II) and has the maximum absorption wavelength of 360±20 nm, and a coupler which reacts with the compound to produce color, the layers being coated on a support in this order.

The maximum absorption wavelengths of at least two compounds represented by the formula (I) or (II) whose photosensitive wavelengths are different from each other or those of the compound represented by the formula (I) or (II) and the diazonium salt compound are not limited to those exemplified above, however, it is preferred that these two maximum absorption wavelengths differ at least 20 nm from the viewpoint of conducting light fixation successively.

In the present invention, the maximum absorption wavelength of the compound represented by the formula (I) or (II), or the diazonium salt compound is measured by a spectrophotometer ("MPS-2000", trade name; product of Shimadzu-Corporation) after forming a film having a coating amount of 0.1 g/m$^2$ to 1.0 g/m$^2$.

In the present invention, the above-described heat-sensitive recording layers can be superposed one after another. By changing the hue of each heat-sensitive recording layer, a multi-color heat-sensitive recording material can be obtained.

There is no particular limitation of the constitution of layers, but the following constitution can be given as one example of a multi-color heat-sensitive recording material, that is, the material obtained by superposing two heat-sensitive recording layers containing two compounds which are different in photosensitive wavelength and are each represented by the formula (I) or (II) and couplers which produce colors different in hue by the reaction with the respective two compounds by heating; and a heat-sensitive layer containing an electron-donating colorless dye and an electron-accepting compound in combination. In other words, it is a multi-layer heat-sensitive recording material which comprises, on a substrate, a first heat-sensitive recording layer containing an electron-donating colorless dye and an electron-accepting compound, a second heat-sensitive recording layer containing a compound which is represented by the formula (I) or (II) and has the maximum absorption wavelength of 360±20 nm, and a coupler which reacts with the compound to produce color by heating, and a third heat-sensitive recording layer containing a compound which is represented by the formula (I) or (II) and has the maximum absorption wavelength of 400±20 nm, and a coupler which reacts with the compound to produce color by heating. In this example, if the color hues of these heat-sensitive recording layers to be produced are selected to be three primary colors, that is, yellow, magenta and cyan in the subtractive color process, respectively, it is possible to conduct image recording in full color.

The recording of this multi-color heat-sensitive recording material is conducted as follows: first, the third heat-sensitive recording layer is heated to effect color development of the compound represented by the formula (I) or (II) and the coupler which are contained in the layer. The third heat-sensitive recording layer is then exposed to light at 400±20 nm to decompose the unreacted compound contained in the third layer. Sufficient heat is then applied to the second heat-sensitive recording layer to develop color, whereby the color development of the compound represented by the formula (I) or (II) and coupler contained in the second layer is effected. At this time, the third heat-sensitive recording layer is heated together with the second heat-sensitive recording layer, but the compound represented by the formula (I) or (II) has already been decomposed and lost in its chromophoric capacity. The third heat-sensitive recording layer therefore does not develop color. The second heat-sensitive recording layer is then exposed to light at 360±20 nm to decompose the compound contained in the second layer. Finally, heat sufficient for causing color development of the first heat-sensitive recording layer is applied. At this time, the third and second heat-sensitive recording layers are heated intensely at the same time but the compounds represented by the formula (I) or (II) have already been decomposed and lost in their chromophoric capacities so that these two layers do not develop color.

Specific examples of the diazonium salt compound usable in the heat-sensitive recording material of the present invention include acid anionic salts such as 4-(N-(2-(2,4-di-tert-amylphenoxy)butyryl)piperazino)benzene diazonium, 4-dioctylaminobenzene diazonium, 4-(N-(2-ethylhexanoyl)piperazino)benzene diazonium, 4-dihexylamino-2-hexyloxybenzene diazonium, 4-N-ethyl-N-hexadecylamino-2-ethoxybenzodiazonium, 3-chloro-4-dioctylamino-2-octyloxybenzene diazonium, 2,5-dibutoxy-4-morpholinobenzene diazonium, 2,5-octoxy-4-morpholinobenzene diazonium, 2,5-dibutoxy-4-(N-(2-ethylhexanoyl)piperazino)benzene diazonium, 2,5-diethoxy-4-(N-(2-(2,4-di-tert-amylphenoxy)butyryl)piperazino)benzene diazonium, 2,5-dibutoxy-4-tolylthiobenzene diazonium and 3-(2-octyloxyethoxy)-4-morpholinobenzene diazonium, and diazonium salt compounds (D-1) to (D-5) described below. Among these, hexafluorophosphate salts, tetrafluoroborate salts and 1,5-naphthalenesulfonate salts are preferred.

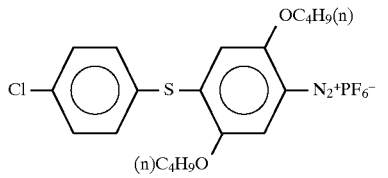

D-1

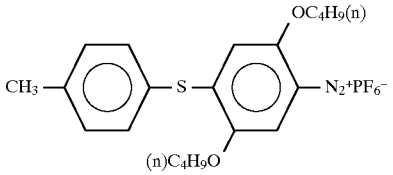

D-2

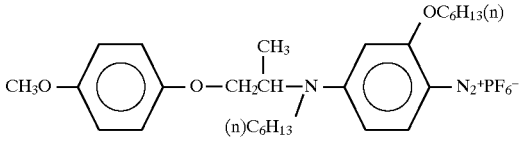

D-3

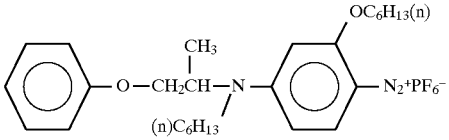

D-4

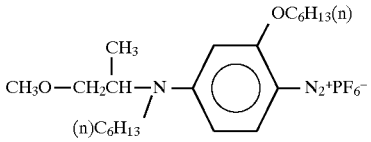

D-5

In the present invention, examples of the chromophoric component usable for the heat-sensitive recording layer include those making use of the reaction between the compound represented by the formula (I) or (II), or the above-described diazonium salt compound and a coupler, and those making use of the reaction between an electron-donating colorless dye and an electron-accepting compound. Exemplary electron-donating colorless dyes usable in the heat-sensitive recording material of the present invention include triarylmethane type compounds, diphenylmethane type compounds, thiazine type compounds, xanthene type compounds and spiropyran type compounds. Above all, triarylmethane type compounds and xanthene type compounds are useful because of a high chromophoric density. Some of the specific examples of the electron-donating colorless dye include 3,3-bis(p-dimethylaminophenyl)-6-dimethylaminophthalide (i.e., crystal violet lactone), 3,3-bis(p-dimethylamino)phthalide, 3-(p-dimethylaminophenyl)-3-(1,2-dimethylindol-3-yl)phthalide, 3-(p-dimethylaminophenyl)-3-(1-octyl-2-methylindol-3-yl)phthalide, 3-(o-methyl-p-diethylaminophenyl)-3-(1-ethyl-2-methylindol-3-yl)-4-azaphthalide, 4,4'-bis(dimethylamino)benzhydrinbenzyl ether, N-halophenyl leuco auramine, N-2,4,5-trichlorphenyl leuco auramine, rohdamine-B-anilinolactam, rohdamine(p-nitroanilino)lactam, rohdamine-B-(p-chloroanilino)lactam, 2-benzylamino-6-diethylaminofluoran, 2-anilino-6-diethylaminofluoran, 2-anilino-3-methyl-6-diethylaminofluoran, 2-anilino-3-methyl-6-cyclohexylmethylaminofluoran, 2-anilino-3-methyl-6-isoamylethylaminofluoran, 2-(o-chloroanilino)-6-diethylaminofluoran, 2-octylamino-6-diethylaminofluoran, 2-ethoxyethylamino-3-chloro-2-diethylaminofluoran, 2-anilino-3-chloro-6-diethylaminofluoran, benzoyl leuco methylene blue, p-nitrobenzyl leuco methylene blue, 3-methyl-spiro-dinaphthopyran, 3-ethyl-spiro-dinaphthopyran, 3,3'-dichloro-spiro-dinaphthopyran, 3-benzylspirodinaphthopyran and 3-propyl-spiro-dibenzopyran.

Examples of the electron-accepting compound include phenol derivatives, salicylic acid derivatives, hydroxybenzoate esters. Particularly, bisphenols and hydroxybenzoate esters are preferred. Some of the specific examples include 2,2-bis(p-hydroxyphenyl)propane (i.e., bisphenol A), 4,4'-(p-phenylene diisopropylidene)diphenol (i.e., bisphenol P), 2,2-bis(p-hydroxyphenyl)pentane, 2,2-bis(p-hydroxyphenyl)ethane, 2,2-bis(p-hydroxyphenyl)butane, 2,2-bis(4'-hydroxy-3',5'-dichlorophenyl)propane, 1,1-(p-hydroxyphenyl)cyclohexane, 1,1-(p-hydroxyphenyl)propane, 1,1-(p-hydroxyphenyl)pentane, 1,1-(p-hydroxyphenyl)-2-ethylhexane, 3,5-di(α-methylbenzyl)salicylic acid and multivalent metal salts thereof, 3,5-di(tert-butyl)salicylic acid and multivalent metal salts thereof, 3-(α,α-dimethylbenzylsalicylic acid and multivalent metal salts thereof, butyl p-hydroxybenzoate, benzyl p-hydroxybenzoate, p-hydroxybenzoic acid-2-ethylhexyl, p-phenylphenol and p-cumylphenol.

EXAMPLES

Preparation Examples of a Diazo Compound Represented By the Formula (I):

1. Preparation Example of the Compound of Specific Example (1)

In a three-necked flask, 20 mmol of 1,2,3-benzotriazin-4-one, 22 mmol of 2,4, 5-trichlorobenzenesulfonyl chloride and 30 ml of acetone were charged. To the resulting mixture, 23 mmol of a 24% aqueous solution of sodium hydroxide were added dropwise under ice cooling, followed by stirring at room temperature for 2 hours. To the reaction mixture, 200 ml of water was added. The crystals so precipitated were filtered and washed with methanol, whereby 7.1 g of the diazo compound of specific example (1) was obtained (decomposition point: 135° C.)

2. Preparation Example of the Compound of Specific Example (2):

In a three-necked flask, 30 mmol of the compound represented by the formula 5, 36 mmol of triethylamine and 50 ml of acetonitrile were charged. To the resulting mixture, 33 mmol of benzenesulfonyl chloride was added dropwise under ice cooling, followed by stirring at room temperature for 2 hours. To the reaction mixture, 150 ml of water was added. The crystals so precipitated were filtered and washed with methanol, whereby 7.8 g of the diazo compound of specific example (2) were obtained (decomposition point: 160° C.).

Formula 5

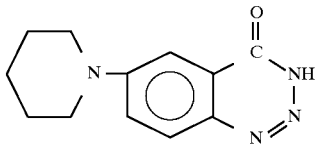

3. Preparation Example of the Compound of Specific Example (7):

In a three-necked flask, 30 mmol of the compound represented by the formula 6, 33 mmol of benzenesulfonyl chloride and 60 ml of acetone were charged. To the resulting mixture, 33 mmol of a 24% aqueous solution of sodium hydroxide was added dropwise under ice cooling, followed by stirring under ice cooling for 2 hours. To the reaction mixture, 100 ml of water and 20 ml of ethyl acetate were added. The organic layer was washed with water and then dried over magnesium sulfate. The solvent was then distilled off. The residue was subjected to chromatography on a silica gel column by using ethyl acetate/n-hexane, whereby 5.7 g of the diazo compound of specific example (7) was obtained (decompositionpoint: 102° C.)

Formula 6

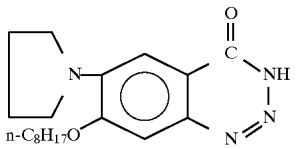

4. Preparation Example of the Compound of Specific Example (11):

In a three-necked flask, 20 mmol of the compound represented by the formula 7, 22 mmol of a 24% aqueous solution of sodium hydroxide and 40 ml of acetone were weighed and charged. To the resulting mixture, 22 mmol of methanesulfonyl chloride was added dropwise under ice cooling, followed by stirring at room temperature for 2 hours. To the reaction mixture, 100 ml of water was added. The crystals so precipitated were filtered and washed with methanol, whereby 6.3 g of the diazo compound of specific example (11) was obtained (decomposition point: 155° C.).

Formula 7

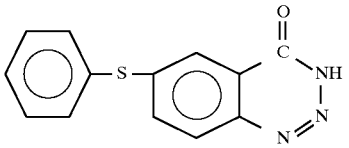

5. Preparation Example of the Compound of Specific Example (12):

In a similar manner to Preparation Example 4 except for the use of 4-chlorobenzenesulfonyl chloride instead of methanesulfonyl chloride, 7.4 g of the compound of specific example (12) was obtained (decomposition point: 177° C.).

6. Preparation Example of the Compound of Specific Example (17):

In a three-necked flask, 20 mmol of the compound represented by the formula 8, 22 mmol of a 24% aqueous solution of sodium hydroxide and 40 ml of acetone were charged. To the resulting mixture, 22 mmol of 2,5-dimethylbenzenesulfonyl chloride was added in portions under ice cooling, followed by stirring at room temperature for 2 hours. To the reaction mixture, 100 ml of water was added. The crystals so precipitated were filtered and washed with methanol, whereby 7.3 g of the diazo compound of specific example (17) was obtained (decomposition point: 141° C.).

Formula 8

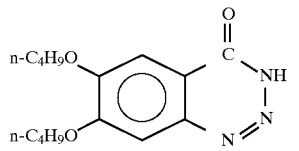

7. Preparation Example of the Compound of Specific Example (25):

In a similar manner to Preparation Example (4) except for the use of di-2-ethylhexyl chlorophosphonate instead of methanesulfonyl chloride, 7 g of the compound of specific example (25) was obtained in the form of an oil.

Preparation Examples of a Diazo Compound Represented By the Formula (II):

1. Preparation Example of the Compound of Specific Example (29):

In a three-necked flask, 20 mmol of the compound represented by the formula 9, 22 mmol of pyridine and 40 ml of acetone were charged. To the resulting mixture, 22 mmol of benzoyl chloride was added dropwise under ice cooling, followed by stirring at room temperature for 2 hours. To the reaction mixture, 200 ml of water were added. The crystals so precipitated were filtered and washed with methanol, whereby 5.8 g of the diazo compound of specific example (29) was obtained (decomposition point: 224° C.).

Formula 9

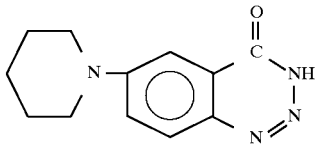

2. Preparation Example of the Compound of Specific Example (34):

In a three-necked flask, 10 mmol of the compound represented by the formula 10, 40 mmol of concentrated hydrochloric acid and 50 ml of tetrahydrofuran were charged. To the resulting mixture, an aqueous solution of 11 mmol of sodium nitrite in 5 ml of water was added dropwise at 5° C. or lower. After stirring at 5° C. for one hour, 200 ml of water was added to the reaction mixture. The crystals so precipitated were filtered and washed with methanol, whereby 4.8 g of the diazo compound of specific example (34) was obtained (decomposition point: 117° C.).

Formula 10

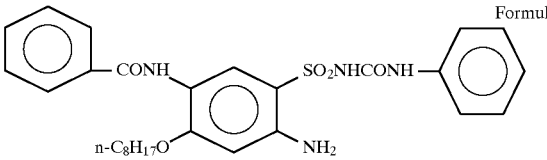

3. Preparation Example of the Compound of Specific Example (35):

In a three-necked flask, 10 mmol of the compound represented by the formula 11, 40 mmol of concentrated hydrochloric acid and 50. ml of tetrahydrofuran were charged. To the resulting mixture, an aqueous solution of 11 mmol of sodium nitrite in 5 ml of water was added dropwise at 5° C. or lower. After stirring at 5° C. for one hour, 200 ml of water was added to the reaction mixture. The crystals so precipitated were filtered and washed with methanol, whereby 5.0 g of the diazo compound of specific example (35) was obtained (decomposition point: 126° C.).

Formula 11

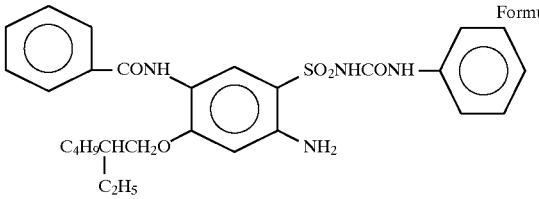

4. Preparation Example of the Compound of Specific Example (45):

In a three-necked flask, 10 mmol of the compound represented by the formula 12, 40 mmol of concentrated hydrochloric acid and 50 ml of tetrahydrofuran were charged. To the resulting mixture, an aqueous solution of 11 mmol of sodium nitrite in 5 ml of water was added dropwise at 5° C. or lower. After stirring at 5° C. for one hour, 200 ml of water was added to the reaction mixture. The crystals so precipitated were filtered and washed with isopropyl alcohol, whereby 3.6 g of the diazo compound of specific example (45) was obtained (decomposition point: 131° C.).

Formula 12

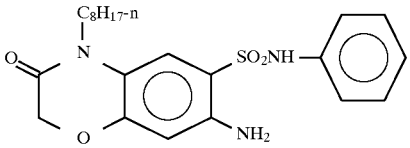

5. Preparation Example of the Compound of Specific Example (46):

In a three-necked flask, 10 mmol of the compound represented by the formula 13, 40 mmol of concentrated hydrochloric acid and 50 ml of tetrahydrofuran were charged. To the resulting mixture, an aqueous solution of 11 mmol of sodium nitrite in 5 ml of water was added dropwise at 5° C. or lower. After stirring at 5° C. for one hour, 200 ml of water was added to the reaction mixture. The crystals so precipitated were filtered and washed with methanol, whereby 4.0 g of the diazo compound of specific example (46) was obtained (decomposition point: 121° C.).

Formula 13

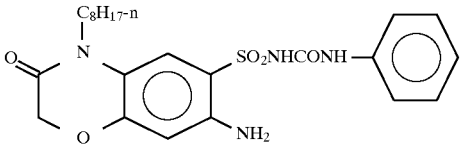

[Preparation of Heat-sensitive Recording Materials and Evaluation Thereof]

All designations of part or parts mean part or parts by weight. The reflection density was measured using a reflection densitometer ("RD918", trade name; product of Macbeth Inc.). The evaluation of the light fixing property of the diazo type heat-sensitive recording layer was conducted by confirming whether color development occurred (in other words, fixation was accomplished) or not by the application of heat at 86 mJ/mm$^2$ to non-printed portion after fixing operation by exposure to light for a predetermine time. Those in which fixation was accomplished were evaluated as A, while those producing color (not fixed) were evaluated as B.

The evaluation of light fastness was conducted using a weatherometer ("WEATHER O METER CI 65", trade name; product of ATLAS ELECTRIC DEVICES CO.). The sample was exposed to 0.9 W/m$^2$ for 48 hours and the remaining ratio of the dye in the image portion was calculated in accordance with the following formula, whereby evaluation was conducted.

Remaining ratio (%) in the image portion=[(reflection density after exposure to light)/(reflection density before exposure to light)]×100

When the remaining ratio of the dye is high, the heat-sensitive recording material is judged to have excellent light fastness.

Example 1

[Preparation of the Solution of a Heat-Sensitive Recording Layer]

(Preparation of a Capsule Solution of a Diazo Compound)

To 2.8 parts of each of the compounds shown as specific example (10) and specific example (31), 2.8parts of dibutyl sulfate and 0.56 part of 2,2-dimethoxy-1,2-diphenylethane-1-one ("Irgacure 651", trade name; product of CIBA-GEIGY, Ltd.) were added and the resulting mixture was dissolved in 19.0 parts of ethyl acetate. To the solution so obtained, 5.9 parts of isopropyl biphenyl and 2.5 parts of tricresyl phosphate, which were high-boiling point solvents, were added, followed by heating and uniform mixing. To the resulting mixture, 7.6 parts of a xylylene diisocyanate/trimethylol propane adduct (a 75% solution of ethyl acetate; "Takenate D110N", trade name; product of Takeda Chemical Industries, Ltd.) as a capsule forming agent were added and they were stirred uniformly. Separately, 64 parts of a 6 wt. % aqueous solution of gelatin ("MGP-9066", trade name; product of Nippi, Incorporated), to which 2.0 parts of a 10 wt. % aqueous solution of sodium dodecylsulfonate had been added, were prepared. The solution of the diazonium salt compound prepared above was added, followed by emulsion dispersion in a homogenizer. To the emulsion so obtained, 20 parts of water were added, followed by homogenization. The homogeneous emulsion so obtained was heated to 40° C., while stirring, and encapsulation reaction was conducted for 3 hours. After the liquid temperature was lowered to 35° C., 6.5partsofanionexchangeresin ("Amberlite IRA68", trade name; product of Organo Corporation) and 13 parts of "Amberlite IRC 50" (trade name; product of Organo Corporation) were added, followed by stirring for one hour. The ion exchange resin was then filtered off. In this manner, the target capsule solutions (I) and (II) were obtained. The capsules each had an average particle size of 0.66 μm.

(Preparation of a Coupler Emulsion Dispersion)

In 10.5 parts of ethyl acetate, 3.0 parts of Compound (b-1) as a coupler which will be shown below, 4.0 parts of triphenyl guanidine, 4.0 parts of 1,1-(p-hydroxyphenyl)-2-ethylhexane, 8.0 parts of 4,4'-(p-phenylenediisopropylidene) diphenol and 8.0 parts of 2-ethylhexyl-4-hydroxybenzoate, and 2 parts of Compound (b-2) as an ultraviolet absorbing agent which will be shown below and 2.0 parts of 1,1,3-tris (2-methyl-4-hydroxy-5-t-butylpheyl)butane were dissolved, followed by the addition of 0.48 part of tricresyl phosphate, 0.24 part of diethyl maleate and 1.27 parts of Pionin A41C (trade name; product of Takemoto Oil & Fat Co., Ltd.) which were high-boiling-point solvents. The resulting mixture was heated and mixed uniformly. The mixture so obtained was added to 93 parts of a 8 wt. % aqueous solution of gelatin ("#750 gelatin", trade name; product of Nitta Gelatin Inc.), followed by emulsion dispersion in a homogenizer. From the emulsion so obtained, the remaining ethyl acetate was evaporated, whereby the target emulsion dispersion was obtained.

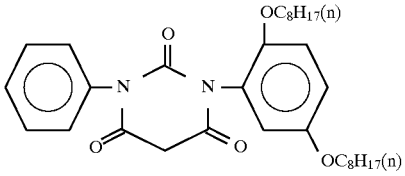

b-1

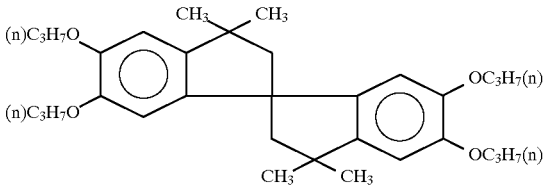

b-2

(Preparation of a Coating Solution)

Each of the above-described capsule solutions (I) and (II) of a diazo compound, the coupler emulsion dispersion and a styrene-butadiene rubber ("SBR:SN307", trade name; product of Sumitomo Naugatuck Co. , Ltd. ) were mixed so that the ratio of the diazo compound to the coupler is 1:2 and the ratio of the diazo compound to the styrene-butadiene rubber is 1:6.4, whereby each of the target coating solutions (I) and (II) was prepared.

(Preparation of a Coating Solution as a Protective Layer)

To 61 parts of a 5.0 wt. % aqueous solution of carboxy-modified polyvinyl alcohol ("KL-318", trade name; product of Kuraray Co., Ltd.), 2.0 parts of a 20.5 wt. % dispersion of zinc stearate ("Highdrin F115", trade name; product of Chukyo Yushi Co., Ltd.) were added, followed by the addition of 8.4 parts of a 2 wt. % aqueous solution of Compound (c-1) which will be described below, 8.0 parts of a fluorine-type mold releasing agent ("ME-313", trade name; Daikin Industries, Ltd.) and 0.5 part of wheat starch ("KF-4", trade name; product of Kagoshima Starch Co., Ltd.). They were stirred uniformly. The reaction mixture so obtained will hereinafter be called "mother liquid". Separately, 12.5 parts of a 20 wt. % aqueous solution of "Caogloss" (trade name, product of Shiraishi Kogyo Kaisha, Ltd.), which had been subjected to ion exchange, 0.06 part of "Poise 532A" (trade name; product of Kao Corporation), 1.87 parts of "Hidrin Z-7" (trade name; product of Chukyo Yushi Co., Ltd.), 1.25 parts of 10 wt. % polyvinyl alcohol ("PVA105", trade name; product of Kuraray Co., Ltd.) and 0.39 part of a 2 wt. % aqueous solution of sodium dodecylsulfonate were mixed, followed by fine dispersion in a Dynomill. The fine dispersion so obtained will hereinafter be called "pigment dispersion". To 80 parts of the mother liquid, 4.4 parts of the pigment dispersion were added, followed by stirring for at least 30 minutes. To the reaction mixture, 2.8 parts of "Wetmaster 500" (trade name, product of Toho Chemical Industry Co., Ltd.) were added. The resulting mixture was stirred for at least 30 minutes, whereby the target coating solution was obtained.

$C_{12}H_{25}$ $(CH_2CH_2O)$ H (c-1)

[Preparation of a Heat-Sensitive Recording Material]

On a substrate for photographic printing paper having a polyethylene film laminated on a woodfree paper, a heat-sensitive recording layer containing each of the compound represented by the formula (I) and (II), and the protective layer were coated successively in this order by a mayor bar and then dried, whereby each of the target heat-sensitive recording materials (I) and (II) was obtained. In each case, the heat-sensitive recording layer was coated to give a coat weight of 8.40 g/m$^2$, while the protective layer was coated to give a coat weight of 1.23 g/m$^2$ in terms of a solid content.

(Heat-Sensitive Recording)

Printing of the heat-sensitive recording material so obtained was conducted using a thermal head ("Thermal Head KST", trade name; product of Kyocera Corp.). The applied voltage and pulse width of the thermal head were determined so that the recording energy per unit area was 62 mJ/mm$^2$. By the printing, the heat sensitive recording material (I) produced orange color, while the heat-sensitive recording material (II) produced yellow color. The heat-sensitive recording material was then exposed for 200 seconds to an ultraviolet lamp having a luminescence center wavelength of 365 nm and an output of 40 W, whereby fixation was effected.

Example 2

In a similar manner to Example 1 except that the compounds of Specific Examples (7) and (28) were used instead of the compounds of Specific Examples (10) and (31), heat-sensitive recording materials (III) and (IV) were prepared and evaluated, respectively. When the printing of the heat-sensitive recording materials so obtained were conducted, the heat sensitive recording material (III) produced yellow color, while the heat sensitive recording material (IV) produced orange color.

Example 3

In a similar manner to Example 1 except that the compounds of Specific Examples (17) and (46) were used instead of the compounds of Specific Examples (10) and (31), heat-sensitive recording materials (V) and (VI) were prepared and evaluated, respectively. When the printing of the heat-sensitive recording materials so obtained were conducted, each of the heat sensitive recording materials (V) and CVI) produced yellow color.

Example 4

In a similar manner to Example 1 except that the compounds of Specific Examples (13) and (34) were used instead of the compounds of Specific Examples (10) and (31), heat-sensitive recording materials (VII) and (VIII) were prepared and evaluated, respectively. When the printing of the heat-sensitive recording materials (VII) and (VIII) so obtained were conducted, the heat sensitive recording material (VII) produced orange color while the heat sensitive recording material (VIII) produced yellow color.

Example 5

In a similar manner to Example 1 except that the compound of Specific Examples (13) was used instead of the compound of Specific Example (10), the compound of Specific Example (45) was used instead of the compound of Specific example (31), and Compound (b-3), which will be described below, was used as a coupler instead of Compound (b-1), heat-sensitive recording materials (IX) and (X) were prepared and evaluated, respectively. When the printing of the heat-sensitive recording materials (IX) and (X) so obtained were conducted, each of the heat sensitive recording materials produced magenta color.

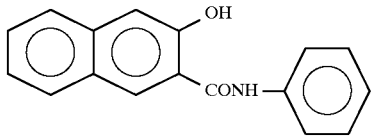

b-3

Example 6

In a similar manner to Example 1 except that the compound of Specific Example (9) was used instead of the compound of Specific Example (10), the compound of Specific Example (45) was used instead of the compound of Specific example (31), and Compound (b-4) was used as a coupler instead of Compound (b-1), heat-sensitive recording materials (XI) and (XII) were prepared and evaluated, respectively. When the printing of the heat-sensitive recording materials so obtained were conducted, the heat sensitive recording material (XI) produced reddish brown color while the heat sensitive recording material (XII) produced orange color.

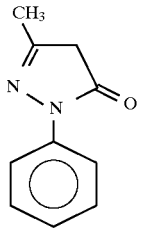

b-4

Example 7

In a similar manner to Example 1 except that the compound of Specific Example (13) was used instead of the compound of Specific Example (10), and acetoacetanilide was used as a coupler instead of Compound (b-1), heat-sensitive recording material (XIII) was prepared and evaluated. When the printing of the heat-sensitive recording material (XIII) was conducted, the heat sensitive recording material produced yellow color.

Example 8

In a similar manner to Example 1 except that the compound of Specific Example (45) was used instead of the compound of Specific Example (31), heat-sensitive recording material (XIV) was prepared and evaluated. When the printing of the heat-sensitive recording material (XIV) was conducted, the heat sensitive recording material produced yellow color.

Comparative Example 1

In a similar manner to Example 1 except that Compound (a-1) which will be described below was used instead of the compounds of Specific Example (10) and Specific Example (31), a heat-sensitive recording material was prepared and evaluated. When the printing of the heat-sensitive recording material so obtained was conducted, the recording material produced magenta color.

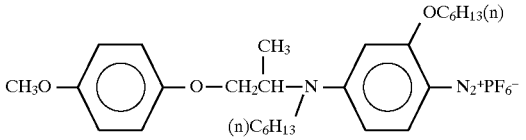

a-1

Comparative Example 2

In a similar manner to Example 1 except that Compound (a-2) which will be described below was used instead of the compounds of Specific Example (10) and Specific Example (31), a heat-sensitive recording material was prepared and evaluated. When the printing of the heat-sensitive recording material was conducted, the recording material produced orange color.

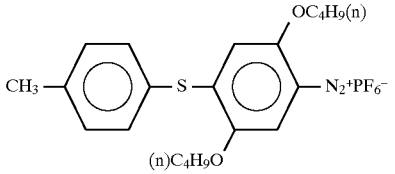

a-2

Comparative Example 3

In a similar manner to Example 1 except that Compound (a-3) which will be described below was used instead of the compounds of Specific Example (10) and Specific Example (31), a heat-sensitive recording material was prepared and evaluated. When the printing of the heat-sensitive recording material so obtained was conducted, the recording material produced yellow color.

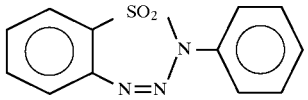

a-3

Evaluation results of Examples 1–8 and Comparative Examples 1–3 are shown in Table 1.

TABLE 1

| | Heat-sensitive recording material | Light fixing property | Light fastness (image portion) |
|---|---|---|---|
| Example 1 | I | A | 86% |
| | II | A | 83% |
| Example 2 | III | A | 83% |
| | IV | A | 82% |
| Example 3 | V | A | 87% |
| | VI | A | 85% |
| Example 4 | VII | A | 87% |
| | VIII | A | 84% |
| Example 5 | IX | A | 92% |
| | X | A | 90% |
| Example 6 | XI | A | 85% |
| | XII | A | 83% |
| Example 7 | XIII | A | 83% |
| Example 8 | XIV | A | 84% |
| Comparative Example 1 | | A | 70% |
| Comparative Example 2 | | A | 72% |
| Comparative Example 3 | | B | 85% |

As is apparent from Table 1, it has been found that heat-sensitive recording materials I–XIV prepared in Examples 1–8 each has a good light fixing property, and has a high colorant remaining ratio on the image portion so that it has excellent light fastness in the image portion.

It has also been found that in Comparative Examples 1 and 2 wherein a diazonium salt compound known to date was used, a light fixing property was good but light fastness on the image portion was insufficient. The heat-sensitive recording material prepared in Comparative Example 3 which employed a diazo compound having a benzotriazine skeleton similar to that of the compound represented by (I) or (II) but being a diazonium compound outside the scope of the present invention has no problem in light fastness on the image portion but has not light fixing property.

What is claimed is:

1. In a heat-sensitive recording material which comprises a substrate and a heat-sensitive recording layer provided thereon, said heat-sensitive recording layer containing a diazo compound and a coupler compound which reacts with said diazo compound to produce color, wherein as the diazo compound, contained is the compound represented by the following general formula (I):

General Formula I

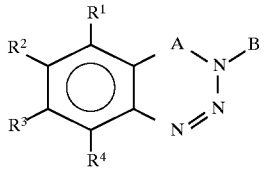

wherein $R^1$ to $R^4$ each independently represents a hydrogen atom, an alkyl group, an aryl group, —$OR^5$, —$SR^6$, —$NR^7R^8$, —$COR^{10}$, a halogen atom, —$SO_2R^{10}$, —CN, —$NO_2$, in which $R^5$ and $R^6$ each independently represents a hydrogen atom, an alkyl group, an aryl group or an acyl group, $R^7$ and $R^8$ each independently represents a hydrogen atom, an alkyl group, an aryl group, an acyl group, an alkylsulfonyl group or an arylsulfonyl group and $R^7$ and $R^8$ are coupled together to form an alkylene group which may contain —O—, —S—, —$SO_2$— or —$NR^9$, said $R^9$ representing a hydrogen atom, an alkyl group, an aryl group, an acyl group, an alkylsulfonyl group, an arylsulfonyl group, an alkoxycarbonyl group or an aryloxycarbonyl group, $R^{10}$ represents a hydrogen atom, a hydroxyl group, an alkyl group, an aryl group, an alkoxyl group, an aryloxy group or —$NR^7R^8$, said $R^7$ and $R^8$ having the same meanings as defined above;

A represents —CO— or —$SO_2$—; and

B represents —$SO_2R^{11}$ or —$POR^{12}R^{13}$, in which $R^{11}$ represents an alkyl group, an aryl group, a heterocyclic group or —$NR^7R^8$, said $R^7$ and $R^8$ having the same meanings as defined above, and $R^{12}$ and $R^{13}$ each independently represents an alkyl group, an aryl group, an alkoxyl group or an aryloxy group.

2. A heat-sensitive recording material according to claim 1, which further comprises at least one of an intermediate layer and a protective layer.

3. A heat-sensitive recording material according to claim 1, wherein said coupler compound is at least one compound selected from the group consisting of naphthol derivatives, hydroxynaphthoic acid derivatives, phenol derivatives, pyrazolone derivatives, 1,3-diketone derivatives, ketocarboxamide derivatives, pyrazolotriazole derivatives, hydrazone derivatives, hydroxycumarine derivatives and barbituric acid derivatives.

4. A heat-sensitive recording material according to claim 2, wherein said coupler compound is at least one compound selected from the group consisting of naphthol derivatives, hydroxynaphthoic acid derivatives, phenol derivatives, pyrazolone derivatives, 1,3-diketone derivatives, ketocarboxamide derivatives, pyrazolotriazole derivatives, hydrazone derivatives, hydroxycumarine derivatives and barbituric acid derivatives.

5. A heat-sensitive recording material according to claim 1, wherein the heat-sensitive layer contains a compound represented by the formula (I) in the micro-encapsulated form, said microencapsulation having been effected by dissolving the compound represented by the formula (I) and a precursor for a microcapsule wall in an organic solvent which is sparingly soluble or insoluble in water, subjecting the resulting solution to emulsion dispersion in an aqueous solution of a water-soluble macromolecule and forming a macromolecular microcapsule wall on an oil-water interface.

6. A heat-sensitive recording material according to claim 2, wherein the heat-sensitive layer contains a compound represented by the formula (I) in the micro-encapsulated form, said micro-encapsulation having been conducted by dissolving the compound represented by the formula (I) and a precursor for a microcapsule wall in an organic solvent which is sparingly soluble or insoluble in water, subjecting the resulting solution to emulsion dispersion in an aqueous solution of a water-soluble macromolecule and forming a macromolecular microcapsule wall on an oil-water interface.

7. A heat-sensitive recording material according to claim 5, wherein the macromolecular microcapsule wall for said heat-sensitive recording layer is formed of at least one macromolecular substance selected from the group consisting of polyurethane resin, polyurea resin, polyamide resin, polyester resin, polycarbonate resin, aminoaldehyde resin, melamine resin, polystyrene resin, styrene-acrylate resin, styrene-methacrylate copolymer resin, urethane-polyurea resin, gelatin and polyvinyl alcohol.

8. A heat-sensitive recording material according to claim 6, wherein the macromolecular microcapsule wall for said heat-sensitive recording layer is formed of at least one macromolecular substance selected from the group consisting of polyurethane resin, polyurea resin, polyamide resin, polyester resin, polycarbonate resin, aminoaldehyde resin, melamine resin, polystyrene resin, styrene-acrylate resin, styrene-methacrylate copolymer resin, urethane-polyurea resin, gelatin and polyvinyl alcohol.

9. A heat-sensitive recording material according to claim 7, wherein said heat-sensitive recording layer contains at least one compound selected from the group consisting of a basic substance, a sensitizer, an antioxidant, an ultraviolet absorber and a metal salt and metal complex each capable of being chelated with the colorant formed.

10. A heat-sensitive recording material according to claim 8, wherein at least one of said heat-sensitive recording layer, intermediate layer and protective layer contains at least one compound selected from the group consisting of a basic substance, a sensitizer, an antioxidant, a ultraviolet absorber and a metal salt and metal complex each capable of being chelated with the colorant formed.

11. In a heat-sensitive recording material which comprises a substrate and a heat-sensitive recording layer provided thereon, said heat-sensitive recording layer containing a diazo compound and a coupler compound which reacts with said diazo compound to produce color, wherein as the diazo compound, contained is the compound represented by the following general formula (II):

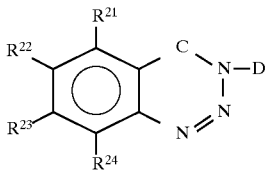

General Formula II wherein $R^{21}$ to $R^{24}$each independently represents a hydrogen atom, an alkyl group, an aryl group, —$OR^{25}$, —$SR^{26}NR^{27}R^{28}$, —$COR^{30}$, a halogen atom, —$SO_2R^{30}$, —CN, —$NO_2$ and at least one of $R^{21}$ to $R^{24}$ represents any one of an aryloxy group, an arylthio-group and —$NR^{27}R^{28}$, in which $R^{25}$ and $R^{26}$ each independently represents a hydrogen atom, an alkyl group, an aryl group or an acyl group, $R^{27}$ and $R^{28}$ each independently represents a hydrogen atom, an alkyl group, an aryl group, an acyl group, an alkylsulfonyl group or an arylsulfonyl group and $R^{27}$ and $R^{28}$ are coupled together to form an alkylene group which may contain —O—, —S—, —$SO_2$— or —$NR^{29}$, $R^{29}$ representing a hydrogen atom, an alkyl group, an aryl group, an acyl group, an alkylsulfonyl group, an arylsulfonyl group, an alkoxycarbonyl group or an aryloxycarbonyl group, and $R^{30}$ represents a hydrogen atom, a hydroxyl group, an alkyl group, an aryl group, an alkoxyl group, an aryloxy group or —$NR^{27}R^{28}$, $R^{27}$ and $R^{28}$ having the same meanings as defined above;

C represents —CO— or —$SO_2$—; and

D represents a hydrogen atom, a hydroxyl group, an alkyl group, an aryl group, a heterocyclic group, —$COR^{31}$ or —$CR^{32}NR^{33}R^{34}$ in which $R^{31}$ represents an alkyl group, an aryl group, an alkoxyl group, an aryloxy group or a heterocyclic group and $R^{32}$ represents =O or =S, and $R^{33}$ and $R^{34}$ each independently represents a hydrogen atom, an alkyl group, an aryl group, an alkylsulfonyl group or an arylsulfonyl group.

12. A heat-sensitive recording material according to claim 11, which further comprises at least one of an intermediate layer and a protective layer.

13. A heat-sensitive recording material according to claim 11, wherein said coupler compound is at least one compound selected from the group consisting of naphthol derivatives, hydroxynaphthoic acid derivatives, phenol derivatives, pyrazolone derivatives, 1,3-diketone derivatives, ketocarboxamide derivatives, pyrazolotriazole derivatives, hydrazone derivatives, hydroxycumarine derivatives and barbituric acid derivatives.

14. A heat-sensitive recording material according to claim 12, wherein said coupler compound is at least one compound selected from the group consisting of naphthol derivatives, hydroxynaphthoic acid derivatives, phenol derivatives, pyrazolone derivatives, 1,3-diketone derivatives, ketocarboxamide derivatives, pyrazolotriazole derivatives, hydrazone derivatives, hydroxycumarine derivatives and barbituric acid derivatives.

15. A heat-sensitive recording material according to claim 11, wherein the heat-sensitive layer has a compound represented by the formula (II) in the micro-encapsulated form, said micro-encapsulation having been effected by dissolving the compound represented by the formula (II) and a precursor for a microcapsule wall in an organic solvent which is sparingly soluble or insoluble in water, subjecting the resulting solution to emulsion dispersion in an aqueous solution of a water-soluble macromolecule and forming a macromolecular microcapsule wall on an oil-water interface.

16. A heat-sensitive recording material according to claim 12, wherein the heat-sensitive layer contains a compound represented by the formula (II) in the micro-encapsulated form, said micro-encapsulation having been effected by dissolving the compound represented by the formula (II) and a precursor for a microcapsule wall in an organic solvent which is sparingly soluble or insoluble in water, subjecting the resulting solution to emulsion dispersion in an aqueous solution of a water-soluble macromolecule and forming a macromolecular microcapsule wall on an oil-water interface.

17. A heat-sensitive recording material according to claim 15, wherein the macromolecular microcapsule wall of said heat-sensitive recording layer is formed of at least one macromolecular substance selected from the group consisting of polyurethane resin, polyurea resin, polyamide resin, polyester resin, polycarbonate resin, aminoaldehyde resin, melamine resin, polystyrene resin, styrene-acrylate resin, styrene-methacrylate copolymer resin, urethane-polyurea resin, gelatin and polyvinyl alcohol.

18. A heat-sensitive recording material according to claim 16, wherein the macromolecular microcapsule wall of said heat-sensitive recording layer is formed of at least one macromolecular substance selected from the group consisting of polyurethane resin, polyurea resin, polyamide resin, polyester resin, polycarbonate resin, aminoaldehyde resin, melamine resin, polystyrene resin, styrene-acrylate resin, styrene-methacrylate copolymer resin, urethane-polyurea resin, gelatin and polyvinyl alcohol.

19. A heat-sensitive recording material according to claim 17, wherein said heat-sensitive recording layer contains at least one compound selected from the group consisting of a basic substance, a sensitizer, an antioxidant, an ultraviolet absorber and a metal salt and metal complex each capable of being chelated with the colorant formed.

20. A heat-sensitive recording material according to claim 18, wherein at least one of the heat-sensitive recording layer, intermediate layer and protective layer contains at least one compound selected from the group consisting of a basic substance, a sensitizer, an antioxidant and a ultraviolet absorber and a metal salt and metal complex each capable of being chelated with the colorant formed.

* * * * *